US009545643B2

(12) United States Patent
Thompson et al.

(10) Patent No.: US 9,545,643 B2
(45) Date of Patent: Jan. 17, 2017

(54) PORTABLE AIRLESS SPRAYER

(71) Applicant: Graco Minnesota Inc., Minneapolis, MN (US)

(72) Inventors: David J. Thompson, Oak Grove, MN (US); Bradley H. Hines, Andover, MN (US); Jerry D. Horning, Albertville, MN (US); William M. Blenkush, Becker, MN (US); Eric J. Finstad, Rogers, MN (US); Marius J. Luczak, Elk River, MN (US); Diane Olson, Princeton, MN (US); Harold D. Johnson, Zimmerman, MN (US); Jimmy Wing Sum Tam, Plymouth, MN (US); Philip K. Snider, Red Wing, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 617 days.

(21) Appl. No.: 13/837,203

(22) Filed: Mar. 15, 2013

(65) Prior Publication Data

US 2013/0277455 A1 Oct. 24, 2013

Related U.S. Application Data

(63) Continuation-in-part of application No. 12/733,643, filed as application No. PCT/US2009/005740 on Oct. 22, 2009, now Pat. No. 8,596,555.

(Continued)

(51) Int. Cl.

| | |
|---|---|
| ***B05B 9/04*** | (2006.01) |
| ***B05B 9/08*** | (2006.01) |
| ***B25F 3/00*** | (2006.01) |

(52) U.S. Cl.

CPC ..... *B05B 9/0416* (2013.01); *B05B 9/0413* (2013.01); *B05B 9/0861* (2013.01); *B05B 9/0866* (2013.01); *B05B 9/0888* (2013.01); *B25F 3/00* (2013.01)

(58) Field of Classification Search

CPC .... B05B 9/0413; B05B 9/0416; B05B 9/0861; B05B 9/0866; B05B 9/0888; B25F 3/00

See application file for complete search history.

(56) References Cited

U.S. PATENT DOCUMENTS

| | | | |
|---|---|---|---|
| 1,911,603 | A | 5/1933 | Breuer |
| 2,195,929 | A | 4/1940 | Klett |

(Continued)

FOREIGN PATENT DOCUMENTS

| | | | |
|---|---|---|---|
| CN | 1185525 | A | 6/1998 |
| CN | 2912820 | Y | 6/2007 |

(Continued)

OTHER PUBLICATIONS

International Search Report and Written Opinion for PCT Application Serial No. PCT/US2009/005740; dated May 27, 2010; 12 pages.

(Continued)

*Primary Examiner* — Darren W Gorman

(74) *Attorney, Agent, or Firm* — Kinney & Lange, P.A.

(57) ABSTRACT

A sprayer attachment for a hand-supported power tool comprises a motion converting mechanism, a pumping mechanism, a spray assembly and a housing. The motion converting mechanism has an input shaft. The pumping mechanism is driven by the motion converting mechanism. The spray assembly is fluidly coupled to the pumping mechanism. The housing assembly couples the motion converting mechanism, the pumping mechanism and the spray assembly. The sprayer attachment may further comprise an anti-rotation bracket extending from the housing. The sprayer attachment may further be coupled to a handheld (Continued)

power tool, such as a cordless drill or a reciprocating saw, with the anti-rotation bracket.

14 Claims, 28 Drawing Sheets

Related U.S. Application Data

(60) Provisional application No. 61/107,374, filed on Oct. 22, 2008, provisional application No. 61/143,910, filed on Jan. 12, 2009, provisional application No. 61/176,194, filed on May 7, 2009, provisional application No. 61/251,597, filed on Oct. 14, 2009.

(56) References Cited

U.S. PATENT DOCUMENTS

| | | | |
|---|---|---|---|
| 2,405,006 | A | 7/1946 | Ashton |
| 2,488,789 | A | 11/1949 | Williams |
| 2,540,357 | A | 2/1951 | Stanley |
| 2,629,539 | A | 2/1953 | Drewes, Jr. |
| 2,736,606 | A | 2/1956 | Kmiotek |
| 2,999,646 | A | 9/1961 | Wagner |
| 3,317,141 | A | 5/1967 | Mann |
| 3,403,818 | A | 10/1968 | Enssle |
| 3,462,082 | A | 8/1969 | Everett |
| 3,633,828 | A | 1/1972 | Larson |
| 3,658,257 | A | 4/1972 | Rood |
| 3,680,981 | A | 8/1972 | Wagner |
| 3,893,627 | A | 7/1975 | Siczek et al. |
| 3,955,763 | A | 5/1976 | Pyle et al. |
| 3,993,250 | A | 11/1976 | Shure |
| 4,033,511 | A | 7/1977 | Chamberlin |
| 4,160,525 | A | 7/1979 | Wagner |
| 4,162,037 | A | 7/1979 | Koyama |
| 4,165,836 | A | 8/1979 | Eull |
| 4,235,377 | A | 11/1980 | Davis et al. |
| 4,294,408 | A | 10/1981 | Snyder et al. |
| 4,301,971 | A | 11/1981 | Cornelius et al. |
| 4,386,739 | A | 6/1983 | Kwok |
| 4,442,977 | A | 4/1984 | Beiswenger et al. |
| 4,484,707 | A | 11/1984 | Calder |
| 4,756,481 | A | 7/1988 | Leuenberger |
| 4,800,801 | A | 1/1989 | van Zweeden |
| 4,971,249 | A | 11/1990 | Tam et al. |
| 5,051,067 | A | 9/1991 | Terauchi |
| 5,054,947 | A | 10/1991 | Frank et al. |
| 5,100,058 | A | 3/1992 | Wei |
| 5,137,431 | A | 8/1992 | Kiyoshi et al. |
| 5,211,611 | A | 5/1993 | Lammers et al. |
| 5,271,537 | A | 12/1993 | Johnson |
| 5,340,029 | A | 8/1994 | Adams |
| 5,391,058 | A | 2/1995 | Goto et al. |
| 5,443,211 | A | 8/1995 | Young et al. |
| 5,699,967 | A | 12/1997 | Conatser et al. |
| 5,769,321 | A | 6/1998 | Cyphers |
| 6,168,093 | B1 | 1/2001 | Greer, Jr. et al. |
| 6,264,115 | B1 | 7/2001 | Liska et al. |
| 6,390,386 | B2 | 5/2002 | Krohn et al. |
| 6,488,180 | B1 * | 12/2002 | Bayat ..... B05C 17/00553 222/137 |
| 6,599,107 | B2 | 7/2003 | Cooper et al. |
| 6,644,564 | B2 | 11/2003 | Perkitny |
| 6,702,198 | B2 | 3/2004 | Tam et al. |
| 6,708,900 | B1 | 3/2004 | Zhu et al. |
| D490,500 | S | 5/2004 | Ye et al. |
| 6,752,067 | B1 | 6/2004 | Davidson et al. |
| 6,752,330 | B2 | 6/2004 | DiMaggio et al. |
| 6,811,099 | B2 | 11/2004 | Krestine et al. |
| 6,817,544 | B2 * | 11/2004 | Hanson ..... B05B 9/0866 239/329 |
| 6,933,634 | B2 | 8/2005 | Frank et al. |
| 7,018,181 | B2 | 3/2006 | Cooper et al. |
| 7,025,087 | B2 | 4/2006 | Weinberger et al. |
| 7,032,841 | B1 | 4/2006 | Swisher |
| 7,097,119 | B2 | 8/2006 | Hornsby et al. |
| 7,182,280 | B2 | 2/2007 | Ye et al. |
| 7,207,500 | B2 | 4/2007 | Hudson et al. |
| 7,219,848 | B2 | 5/2007 | Sweeton |
| 7,244,464 | B2 | 7/2007 | Robens et al. |
| 7,255,294 | B2 | 8/2007 | Sweeton et al. |
| 7,350,723 | B2 | 4/2008 | Reedy |
| 7,354,255 | B1 | 4/2008 | Lishanski et al. |
| 2001/0038041 | A1 | 11/2001 | Leer et al. |
| 2002/0028103 | A1 | 3/2002 | Frank et al. |
| 2003/0173420 | A1 | 9/2003 | Hanson |
| 2004/0069791 | A1 | 4/2004 | Neal |
| 2004/0155118 | A1 | 8/2004 | Rice |
| 2004/0217205 | A1 | 11/2004 | Kohs et al. |
| 2004/0226969 | A1 * | 11/2004 | Shew ..... F16N 3/12 222/333 |
| 2004/0251321 | A1 | 12/2004 | Ye et al. |
| 2005/0016448 | A1 | 1/2005 | Dilou |
| 2005/0189445 | A1 | 9/2005 | Hartle et al. |
| 2006/0040044 | A1 | 2/2006 | Robens et al. |
| 2006/0076434 | A1 | 4/2006 | Hornsby et al. |
| 2006/0086824 | A1 | 4/2006 | Pearce, III et al. |
| 2006/0108981 | A1 | 5/2006 | Watson et al. |
| 2006/0153707 | A1 | 7/2006 | Sweeton et al. |
| 2006/0208005 | A1 | 9/2006 | Sweeton |
| 2007/0025863 | A1 | 2/2007 | Liedtke et al. |
| 2007/0125878 | A1 | 6/2007 | Hahn et al. |
| 2007/0129469 | A1 | 6/2007 | Befurt et al. |
| 2007/0131109 | A1 | 6/2007 | Bruggeman et al. |
| 2007/0134050 | A1 | 6/2007 | Bruggeman et al. |
| 2007/0137938 | A1 | 6/2007 | Carpenter et al. |
| 2007/0170285 | A1 | 7/2007 | Schouten |
| 2007/0212241 | A1 | 9/2007 | Lishanski et al. |
| 2007/0224358 | A1 | 9/2007 | Insausti-Eciolaza et al. |
| 2007/0228186 | A1 | 10/2007 | Hornsby et al. |
| 2007/0252019 | A1 | 11/2007 | Peterson et al. |
| 2007/0261913 | A1 | 11/2007 | Rossner et al. |
| 2007/0272707 | A1 | 11/2007 | Peralta et al. |
| 2007/0278326 | A1 | 12/2007 | Wu |
| 2007/0278787 | A1 | 12/2007 | Jones et al. |
| 2008/0065001 | A1 | 3/2008 | DiNucci et al. |
| 2008/0104780 | A1 | 5/2008 | Dayton et al. |
| 2008/0173705 | A1 | 7/2008 | Girard et al. |
| 2009/0068036 | A1 | 3/2009 | Hsu et al. |
| 2009/0145980 | A1 | 6/2009 | Jones |
| 2009/0152382 | A1 | 6/2009 | Charpie |
| 2010/0072300 | A1 | 3/2010 | Miller et al. |
| 2011/0198413 | A1 | 8/2011 | Thompson et al. |
| 2012/0037726 | A1 | 2/2012 | Johnson et al. |
| 2012/0298771 | A1 | 11/2012 | Johnson et al. |

FOREIGN PATENT DOCUMENTS

| | | | |
|---|---|---|---|
| CN | 101022891 | A | 8/2007 |
| CN | 101049587 | A | 10/2007 |
| CN | 200998701 | Y | 1/2008 |
| CN | 201101999 | Y | 8/2008 |
| CN | 101273198 | A | 9/2008 |
| DE | 2433841 | A1 | 2/1976 |
| DE | 10315483 | A1 | 11/2004 |
| EP | 0312862 | A2 | 4/1989 |
| EP | 0714709 | A1 | 6/1996 |
| EP | 1 479 448 | A2 | 11/2004 |
| EP | 1627689 | A1 | 2/2006 |
| EP | 2168686 | A2 | 3/2010 |
| FR | 2307983 | A1 | 11/1976 |
| GB | 1 576 075 | | 10/1980 |
| GB | 2 302 254 | A | 1/1997 |
| JP | S5138325 | | 3/1976 |
| JP | S57131866 | U | 8/1982 |
| JP | S57200678 | A | 12/1982 |
| JP | S60178368 | U | 11/1985 |
| JP | S6183474 | U | 6/1986 |
| JP | S61255280 | A | 11/1986 |
| JP | S6259989 | B2 | 12/1987 |
| JP | 63100963 | A | 5/1988 |
| JP | S6421769 | U | 2/1989 |
| JP | H01148356 | A | 6/1989 |

(56) References Cited

FOREIGN PATENT DOCUMENTS

| | | | |
|---|---|---|---|
| JP | H2500459 | A | 2/1990 |
| JP | H2196173 | A | 8/1990 |
| JP | 4346862 | A | 12/1992 |
| JP | 194997 | A | 8/1995 |
| JP | 2001506720 | A | 5/2001 |
| JP | 2004261720 | A | 9/2004 |
| JP | 2007222787 | A | 9/2007 |
| JP | 2008246404 | A | 10/2008 |
| JP | 20120506316 | A | 3/2012 |
| KR | 1019970700134 | A | 1/1997 |
| TW | 454575 | U | 9/2001 |
| WO | WO 2007/079932 | A1 | 7/2007 |
| WO | 2010047800 | A2 | 4/2010 |
| WO | WO 2011/094246 | A1 | 8/2011 |

OTHER PUBLICATIONS

Extended European Search Report for EP Application Serial No. 09822319.1; dated Jun. 6, 2012; 8 pages.
European Patent Office, European Search Report, Aug. 8, 2014, 7 pages.
Office Action from Japan Patent Application No. 2014-132047, dated Mar. 24, 2015, 7 pages.
Office Action from Taiwan Patent Application No. 103110772, dated Jul. 7, 2015, 6 pages.
Office Action from Taiwan Patent Application No. 099135095, dated Jul. 7, 2015, 8 pages.
Office Action from Taiwan Patent Application No. 103110772, dated Feb. 15, 2016, 4 pages.
Office Action from Korean Patent Application No. 10-2014-7025680, dated Mar. 25, 2016, 10 pages.

* cited by examiner

PORTABLE AIRLESS SPRAYER

CROSS-REFERENCE TO RELATED APPLICATION(S)

This application claims priority under 35 U.S.C. §120 to U.S. patent application Ser. No. 12/733,643, entitled "PORTABLE AIRLESS SPRAYER," filed Mar. 12, 2010, by D. Thompson, J. Horning, W. Blenkush, E. Finstad, B. Hines, M. Luzak, D. Olson, P. Snider, H. Johnson and J. Wing Sum Tam, the contents of which is incorporated by this reference;

which claims priority under 35 U.S.C. §365 to P.C.T. application PCT/US2009/005740 by D. Thompson, J. Horning, W. Blenkush, E. Finstad, B. Hines, M. Luzak, D. Olson, P. Snider, H. Johnson and J. Wing Sum Tam, filed Oct. 22, 2009;

which claims priority under 35 U.S.C. §119 to U.S. provisional application Ser. Nos. 61/143,910 and 61/107,374, entitled "PORTABLE AIRLESS SPRAYER," filed Jan. 12, 2009 and Oct. 22, 2008, respectively, by David J. Thompson, Jerry D. Horning and William M. Blenkush; and U.S. Provisional application Ser. No. 61/176,194, entitled "PISTON DRIVE SYSTEM USING WOBBLE CONNECTING ROD," filed May 7, 2009 by Harold D. Johnson, Jimmy W. Tam and Bradley H. Hines; and U.S. provisional application Ser. No. 61/251,597, entitled "PORTABLE AIRLESS SPRAYER," FILED Oct. 14, 2009 by D. Thompson, J. Horning, W. Blenkush, E. Finstad, B. Hines, M. Luzak, D. Olson, P. Snider, H. Johnson and J. Wing Sum Tam;

the contents of which are all incorporated by this reference.

BACKGROUND

The present invention is related to portable liquid dispensing systems. In particular, the present invention relates to portable paint sprayers.

Paint sprayers are well known and popular for use in painting of surfaces, such as on architectural structures, furniture and the like. Airless paint sprayers provide the highest quality finish amongst common sprayer system due to their ability to finely atomize liquid paint. In particular, airless paint sprayers pressurize liquid paint to upwards of 3,000 psi [pounds per square inch] (~20.7 MPa) and discharge the paint through small, shaped orifices. Typical airless spray systems, however, require a large stationary power unit, such as an electric motor, a gasoline motor or an air compressor, and a large stationary pumping unit. The power unit is connected to a stationary paint source, such as a 5 gallon bucket, and a spray gun. Thus, such units are well suited for painting large areas that require high quality finishes.

It is, however, often desirable to paint smaller areas for which it is not desirable or feasible to set up an airless spray system. For example, it is desirable to provide touch-up and trim areas having finishes that match the originally painted area. Various types of handheld spray systems and units have been developed to address such situations. For example, buzz guns or cup guns, as they are commonly referred to, comprise small handheld devices electrically powered by connection to a power outlet. Such units do not provide professional grade finishes because, among other things, the low pressures generated and inferior spray nozzles that must be used with the low pressures. There is, therefore, a need for a portable, handheld spray device that produces professional grade finishes.

SUMMARY

In one embodiment, the present disclosure is directed to a sprayer attachment for a hand-supported power tool. The sprayer attachment comprises a motion converting mechanism, a pumping mechanism, a spray assembly and a housing. The motion converting mechanism has an input shaft. The pumping mechanism is driven by the motion converting mechanism. The spray assembly is fluidly coupled to the pumping mechanism. The housing assembly couples the motion converting mechanism, the pumping mechanism and the spray assembly.

In another embodiment, the present disclosure is directed to a portable airless sprayer. The portable airless sprayer comprises a handheld power tool and a sprayer attachment. The handheld power tool comprises a drive element and an output coupling actuated by the drive element. The sprayer attachment comprises an attachment housing, a pumping mechanism disposed in the attachment housing, an input shaft connected to the output coupling to drive the pumping mechanism, and an airless spray tip assembly coupled to the pumping mechanism.

In another embodiment, the present disclosure is directed to a portable sprayer. The portable sprayer comprises a power tool, a sprayer attachment and an anti-rotation bracket. The power tool comprises a housing having a handle, a drive element disposed in the housing, and an output shaft extending from the drive element and out of the housing. The sprayer attachment comprises a pumping mechanism releasably coupled to the output shaft, a fluid cup configured to provide un-pressurized fluid to the pumping mechanism, and a spray assembly configured to receive pressurized fluid from the pumping mechanism. The anti-rotation bracket couples the power tool and the sprayer attachment.

DETAILED DESCRIPTION

Figure 1:
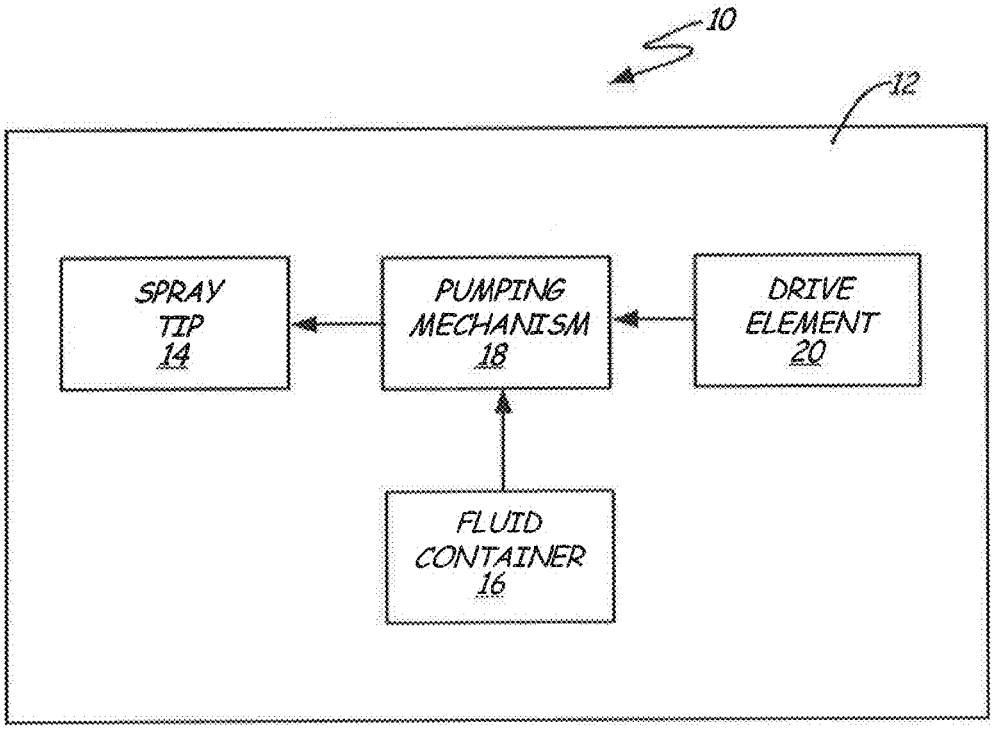
FIG. 1 shows a block diagram of the main components of a portable airless fluid dispensing device of the present invention.
Figure 16:
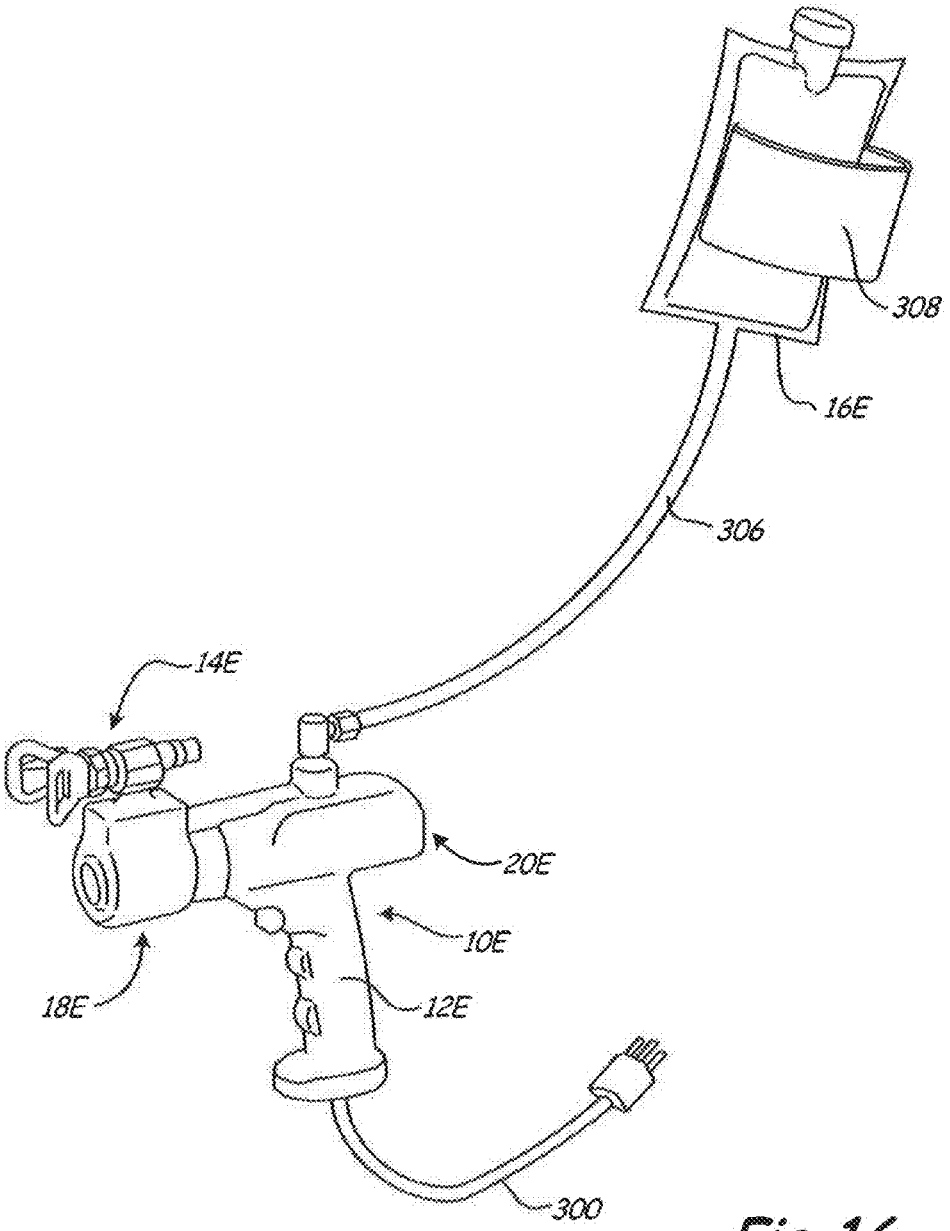
FIG. 16 shows a perspective view of a fifth variation of a handheld sprayer embodiment of the dispensing device of FIG. 1 utilizing an arm bag fluid reservoir.
Figure 17:
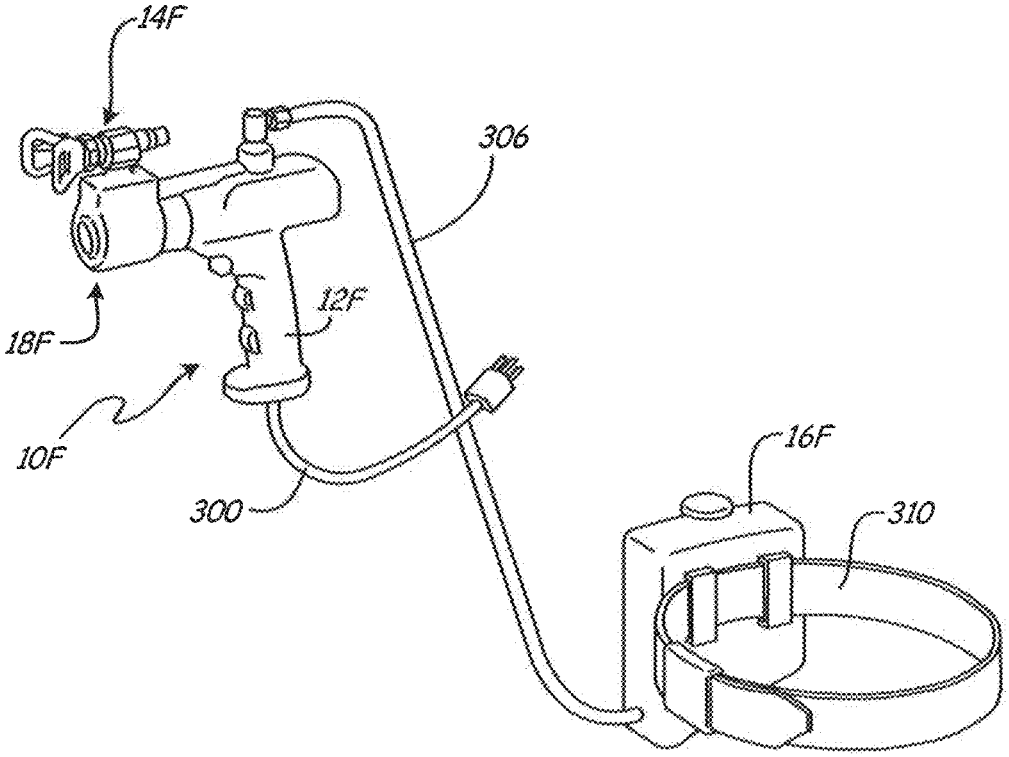
FIG. 17 shows a perspective view of a sixth variation of a handheld sprayer embodiment of the dispensing device of FIG. 1 utilizing a hip pack fluid reservoir.

FIG. 1 shows a block diagram of portable airless fluid dispensing device 10 of the present invention. In the embodiment shown, device 10 comprises a portable airless spray gun comprising housing 12, spray tip assembly 14, fluid container 16, pumping mechanism 18 and drive element 20. In various embodiments of the invention, spray tip assembly 14, fluid container 16, pumping mechanism 18 and drive element 20 are packaged together in a portable spraying system. For example, spray tip assembly 14, fluid container 16, pumping mechanism 18 and drive element 20 can each be mounted directly to housing 12 to comprise an integrated handheld device, as described with respect to FIGS. 2-15. In other embodiments, fluid container 16 can be separated from housing 12 and connected to spray tip assembly 14, pumping mechanism 18 and drive element 20 via a hose, as shown in FIGS. 16-17. In still other embodiments, spray tip assembly 14 can be separated from housing 12 and connected to fluid container 16, pumping mechanism 18 and drive element 20 via a hose, as shown in FIGS. 18-22.

In all embodiments, sprayer 10 comprises an airless dispensing system in which pumping mechanism 18 draws fluid from container 16 and, with power from drive element 20, pressurizes the fluid for atomization through spray tip assembly 14. Pumping mechanism 18 comprises, in different embodiments, a gear pump, a piston pump, a plunger pump, a vane pump, a rolling diaphragm pump, a ball pump, a rotary lobe pump, a diaphragm pump or a servo motor having a rack and pinion drive. Drive element 20 comprises, in different embodiments, an electric motor, an air-driven motor, a linear actuator or a gas engine which can be used to drive cams, a wobble plate or rocker arms. In one embodiment, pumping mechanism 18 generates orifice spray pressure, or running pressure, of about 360 pounds per square inch [psi] (~2.48 MPa) up to about 500 psi (~3.4 MPa) or higher, as driven by drive element 20. However, in other embodiments, pumping mechanism 18 is able to generate pressures up to about 1,000 psi (~6.9 MPa) to approximately 3,000 psi (~20.7 MPa). Combined with spray tip assembly 14, which includes a spray orifice having an area as small as about 0.005 square inches (~3.23 $mm^2$) to about 0.029 square inches (~18.7 $mm^2$), sprayer 10 achieves atomization of fluid architectural coatings, such as paint, stains, varnishes and lacquers, to about 150 microns or smaller, or about 70 microns or smaller on a Dv(50) scale.

Figure 2:
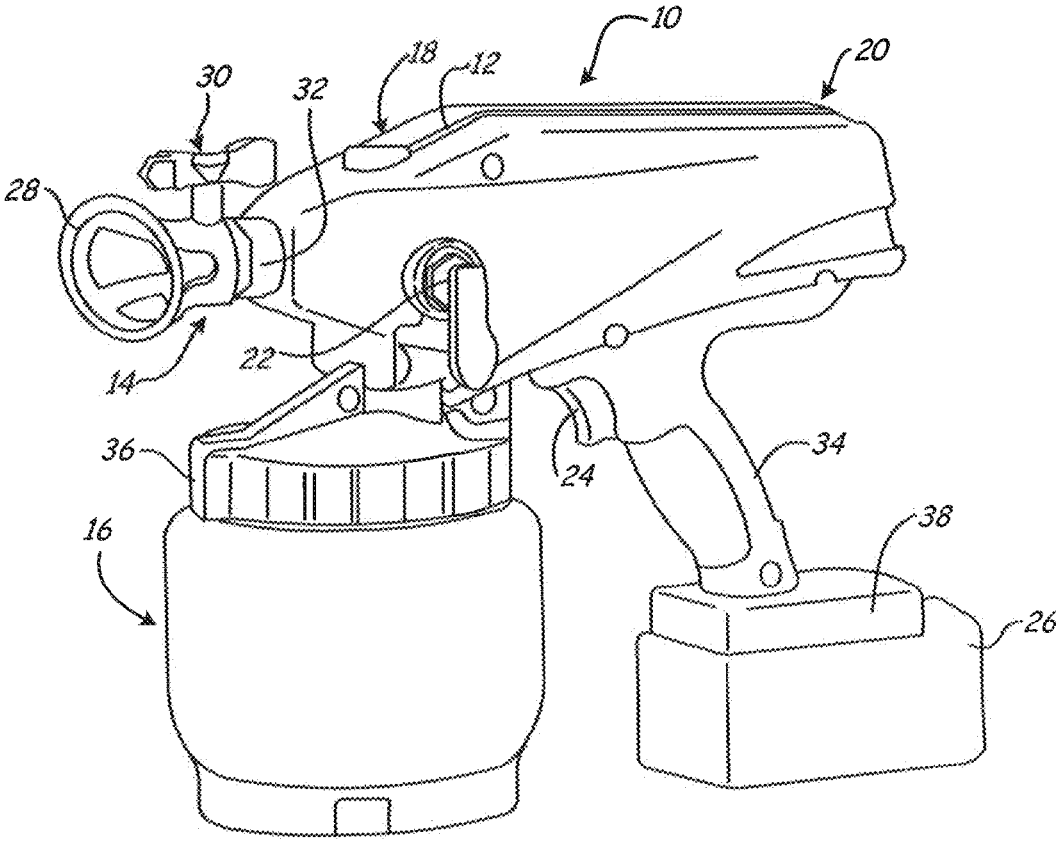
FIG. 2 shows a side perspective view of a handheld sprayer embodiment of the dispensing device of FIG. 1.

FIG. 2 shows a side perspective view of spray gun 10 having housing 12, spray tip assembly 14, fluid container 16, pumping mechanism 18 (disposed within housing 12) and drive element 20 (disposed within housing 12). Spray gun 10 also includes pressure relief valve 22, trigger 24 and battery 26. Spray tip assembly 14 includes guard 28, spray tip 30 and connector 32. Drive element 20 and pumping mechanism 18 are disposed within housing 12. Housing 12 includes integrated handle 34, container lid 36 and battery port 38.

Fluid container 16 is provided with a fluid that is desired to be sprayed from spray gun 10. For example, fluid container 16 is filled with a paint or varnish that is fed to spray tip assembly 14 through coupling with lid 36. Battery 26 is plugged into battery port 38 to provide power to drive element 20 within housing 12. Trigger 24 is connected to battery 26 and drive element 20 such that upon actuation of trigger 24 a power input is provided to pumping mechanism 18. Pumping mechanism 18 draws fluid from container 16 and provides pressurized fluid to spray tip assembly 14. Connector 32 couples spray tip assembly 14 to pump 18. Tip guard 28 is connected to connector 32 to prevents objects from contacting high velocity output of fluid from spray tip 30. Spray tip 30 is inserted through bores within tip guard 28 and connector 32 and includes a spray orifice that receives pressurized fluid from pumping mechanism 18. Spray tip assembly 14 provides a highly atomized flow of fluid to produce a high quality finish. Pressure relief valve 22 is connected to pumping mechanism 18 to open the mechanism to atmospheric pressure.

Figure 3:
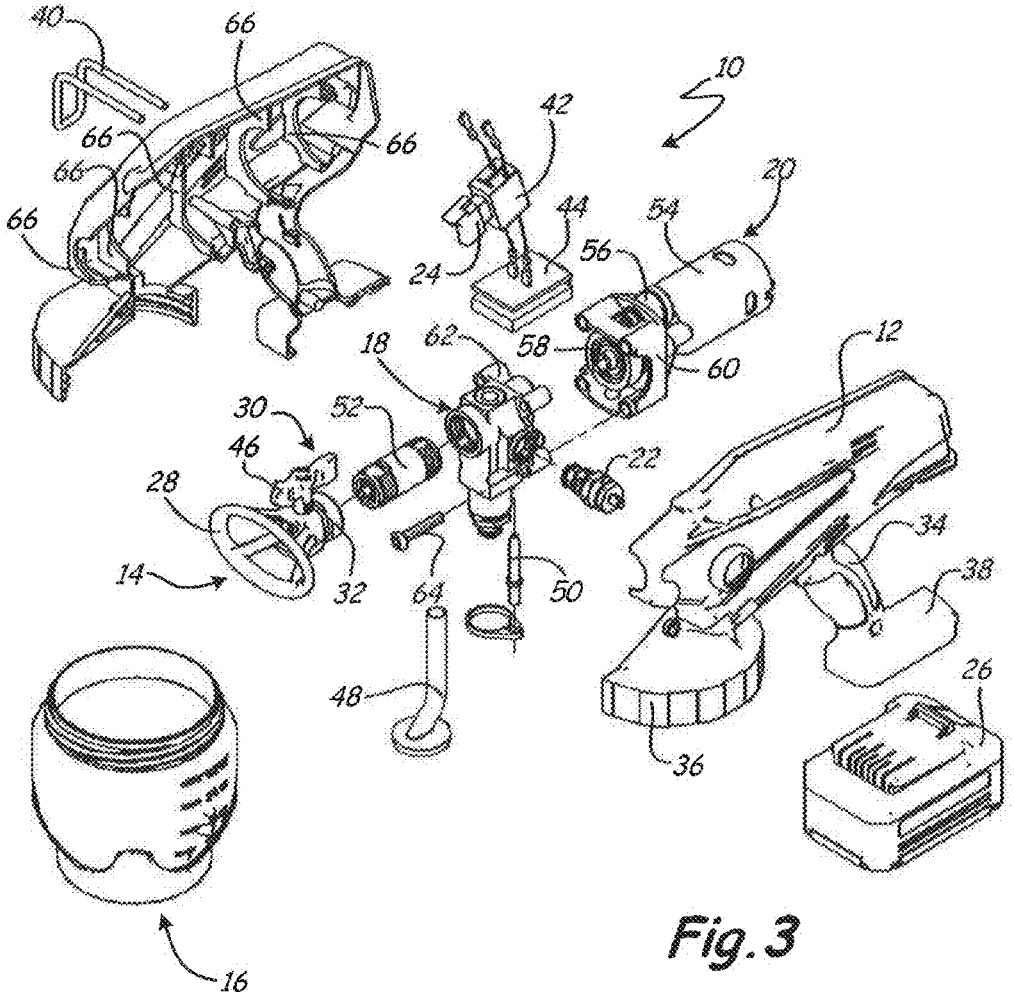
FIG. 3 shows an exploded view of the handheld sprayer of FIG. 2, showing a housing, a spray tip assembly, a fluid cup, a pumping mechanism and a drive element.

FIG. 3 shows an exploded view of spray gun 10 having housing 12, spray tip assembly 14, fluid container 16, pumping mechanism 18 and drive element 20. Spray gun 10 also includes pressure relief valve 22, trigger 24, battery 26, clip 40, switch 42 and circuit board 44. Spray tip assembly 14 includes guard 28, spray tip 30, connector 32 and barrel 46. Pumping mechanism 18 includes suction tube 48, return line 50 and valve 52. Drive element 20 includes motor 54, gearing assembly 56 and connecting assembly 58. Housing 12 includes integrated handle 34, container lid 36 and battery port 38.

Pumping mechanism 18, drive element 20, gearing 56, connection assembly 58 and valve 52 are mounted within housing 12 and supported by various brackets. For example, gearing 56 and connection assembly 58 include bracket 60 which connects to bracket 62 of pumping mechanism 18 using fasteners 64. Valve 52 is threaded into bracket 62, and connector 32 of spray tip 30 is threaded onto valve 52. Spray tip 30, valve 52, pumping mechanism 18 and drive element 54 are supported within housing 12 by ribs 66. In other embodiments of gun 10, housing 12 includes ribs or other features for directly supporting gearing 56 and connecting assembly 58 without the use of bracket 60. Switch 42 is positioned above handle 34 and circuit board 44 is positioned below handle 34 such that trigger 24 is ergonomically positioned on housing 12. Switch 42 includes terminals for connecting with drive element 20, and battery 26 is supported by port 38 of housing 12 in such a manner so as to connect with circuit board 44. Circuit board 44 can be programmed to change voltage supplied to drive element 20 to vary flow from pumping mechanism 18, and to limit current and voltage. Additionally, circuit board 44 can be programmed to use pulse width modulation (PWM) to slow output of drive element 20 when high current is being drawn. In another embodiment, a temperature sensor is incorporated into board 44 to monitor temperatures in the electrical system of spray gun 10, such as temperature of battery 26. Battery 26 may comprise a Lithium battery, a Nickel battery, a Lithium-ion battery or any other suitable rechargeable battery. In one embodiment, battery 26 comprises a 18 VDC battery, although other lower or higher voltage batteries can also be used. Fluid container 16 is threaded into lid 36 of housing 12. Suction tube 48 and return line 50 extend from pumping mechanism 18 into fluid container 16. Clip 40 allows gun 10 to be conveniently stowed such as on a belt of an operator or a storage rack.

To operate gun 10, fluid container 16 is filled with a liquid to be sprayed from spray tip 30. Trigger 24 is actuated by an operator to activate drive element 20. Drive element 20 draws power from battery 26 and causes rotation of a shaft connected to gearing 56. Gearing 56 causes connection mechanism 58 to provide an actuation motion to pumping mechanism 18. Pumping mechanism 18 draws liquid from container 16 using suction tube 48. Excess fluid not able to be processed by pumping mechanism 18 is returned to container 16 through priming valve 22 and return line 50. Pressurized liquid from pumping mechanism 18 is provided to valve 52. Once a threshold pressure level is achieved, valve 52 opens to allow pressurized liquid into barrel 46 of spray tip 30. Barrel 46 includes a spray orifice that atomizes the pressurized liquid as the liquid leaves spray tip 30 and gun 10. Barrel 46 may comprise either a removable spray tip that can be removed from tip guard 28, or a reversible spray tip that rotates within tip guard 28.

Figure 4:
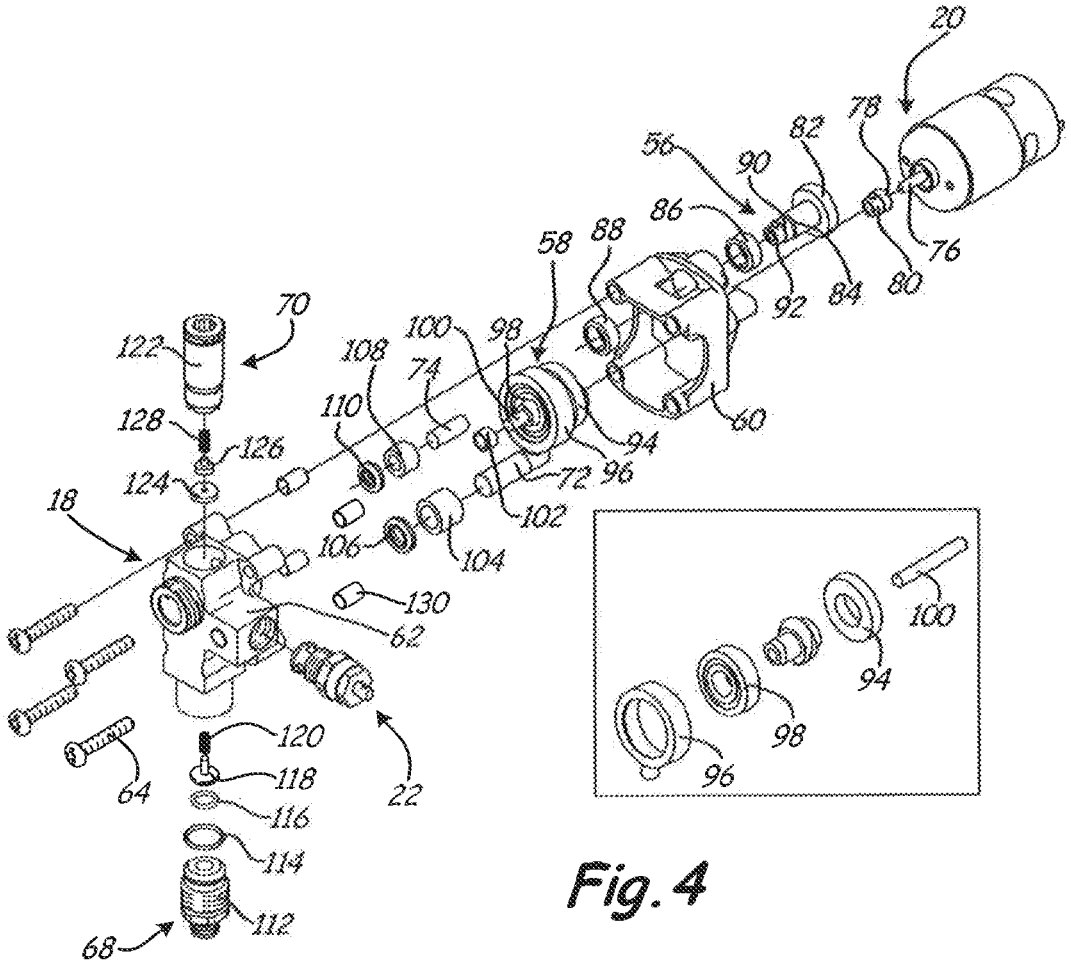
FIG. 4 shows an exploded view of the pumping mechanism and drive element of FIG. 3.

FIG. 4 shows an exploded view of pumping mechanism 18 and drive element 20 of FIG. 3. Pumping mechanism 18 includes bracket 62, fasteners 64, inlet valve assembly 68, outlet valve assembly 70, first piston 72 and second piston 74. Drive element 20 includes drive shaft 76, first gear 78, first bushing 80, second gear 82, shaft 84, second bushing 86, third bushing 88, third gear 90, fourth bushing 92 and fourth gear 94. Connecting mechanism 58 includes connecting rod 96, bearing 98, rod 100 and sleeve 102. First piston 72 includes first piston sleeve 104 and first piston seal 106. Second piston 74 includes second piston sleeve 108 and second piston seal 110. Inlet valve 68 includes first valve cartridge 112, seal 114, seal 116, first valve stem 118 and first spring 120. Outlet valve 70 includes second valve cartridge 122, seat 124, second valve stem 126 and second spring 128.

Drive shaft 76 is inserted into bushing 80 such that gear 78 rotates when drive element 20 is activated. In various embodiments of the invention, bushing 80 and gear 78 are integrally formed as one component. Bushings 86 and 88 are inserted into a receiving bore within bracket 60, and shaft 84 is inserted into bushings 86 and 88. Gear 82 is connected to a first end of shaft 84 to mesh with gear 78, and gear 90 is connected with a second end of shaft 84 to mesh with gear 94. In various embodiments of the invention, gear 82, shaft 84, gear 90 and bushing 92 are integrally formed as one component. Sleeve 102 is inserted into a receiving bore within bracket 62 and rod 100 is inserted into sleeve 102 to support connecting mechanism 58. Bearing 98 connects rod 100 to connecting rod 96. Connecting rod 96 couples with first piston 72. First piston 72 and second piston 74 are inserted into piston sleeves 102 and 108, respectively, which are mounted within pumping chambers within bracket 62. Valve seal 106 and sleeve 108 seal the pumping chambers. Fasteners 64 are inserted through bores in bracket 62 and bushings 130 and threaded into bracket 60. First valve cartridge 112 is inserted into a receiving bore in bracket 62. First spring 62 biases valve stem 128 against cartridge 112. Similarly, second valve cartridge 122 is inserted into a receiving bore in bracket 62 such that spring 128 biases valve stem 126 against bracket 62. Valve cartridges 112 and 122 are removable from bracket 62 such that valve stems 118 and 126 can be easily replaced. Seals 114 and 116 prevent fluid from leaking out of valve 68, and seat 124 prevents fluid from leaking out of valve 70. Valve 22 is inserted into a receiving bore in bracket 62 to intersect fluid flow from pistons 72 and 74.

Figure 5:
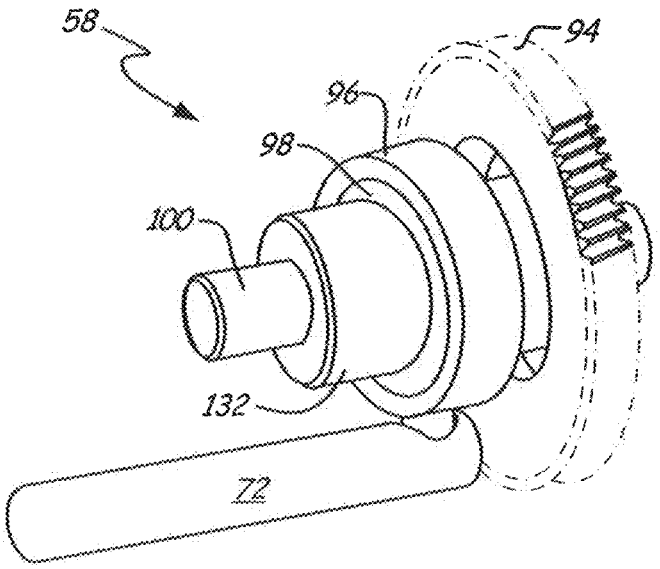
FIG. 5 shows a perspective view of a wobble plate used with the drive element and pumping mechanism of FIG. 4.

FIG. 5 shows a perspective view of connecting mechanism 58 of FIG. 4. Connecting mechanism 58 includes rod 100, upon which land 132, bearing 98, connecting rod 96 and gear 94 are attached. Connecting mechanism provides a connection between drive element 20 and pumping mechanism 18. Piston 72 is connected to connecting rod 96 by a ball and socket, or plug and protrusion, arrangement. Connecting mechanism 58 converts rotational shaft power from drive element 20 to reciprocating motion for piston 72. As is better illustrated in FIGS. 6A and 6B, rotation of rod 100 via gear 94 produces wobble of connecting rod 96 through land 132, which has a surface with an offset axis of rotation. In various embodiments of the invention, rod 100 and land 132 are integrally formed as one component. However, in other embodiments, connecting mechanism 58 may comprise a scotch yoke or another system for converting rotational motion to linear motion.

Figure 6B:
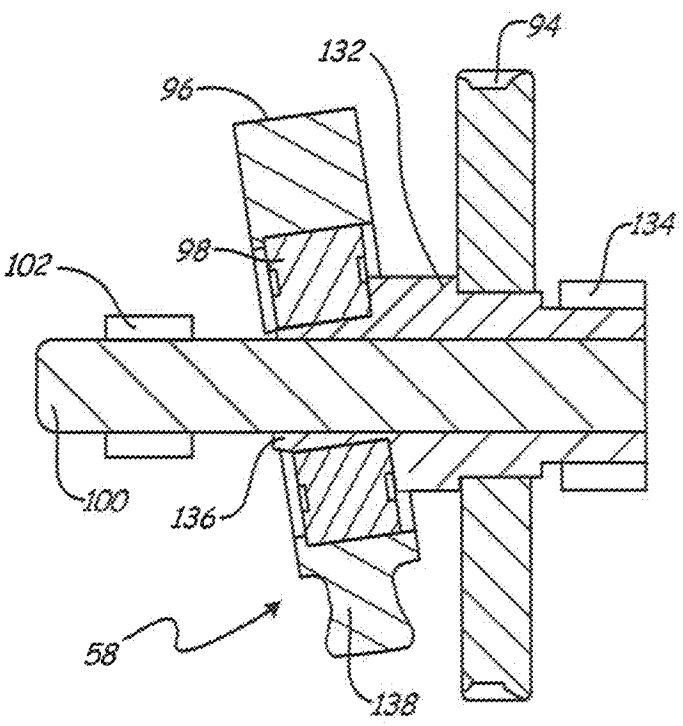
FIG. 6B shows a cross-sectional view of the wobble plate of FIG. 5 in a retracted position.
Figure 6A:
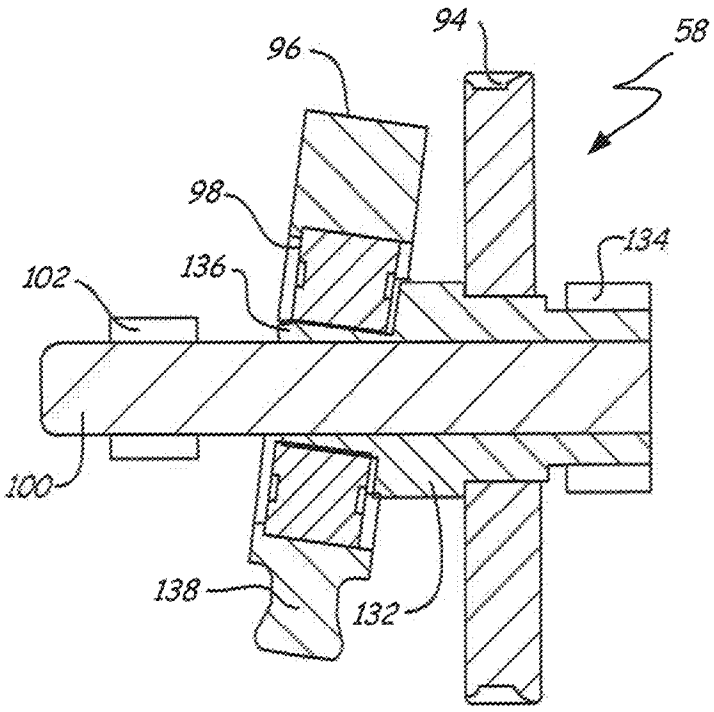
FIG. 6A shows a cross-sectional view of the wobble plate of FIG. 5 in an advanced position.

FIG. 6A shows a cross-sectional view of connecting mechanism 58 of FIG. 5 with connecting rod 96 in an advanced position. FIG. 6B shows a cross-sectional view of connecting mechanism 58 of FIG. 5 with connecting rod 96 in a retracted position. Connecting mechanism 58 includes gear 94, connecting rod 96, bearing 98, rod 100, sleeve 102, land 132 and bushing 134. In such a configuration, connecting mechanism 58 comprises a wobble assembly. FIGS. 6A and 6B, which are discussed concurrently, illustrate the reciprocating motion generated by land 132 when subjected to rotational movement. Rod 100 is supported at a first end by sleeve 102, which is supported in bracket 62 of pumping mechanism 18. Rod 100 is supported at a second end, through land 132, by bushing 134, which is supported in bracket 60. Land 132 is disposed about rod 100 and includes a bushing seat for bushing 134, a gear seat for gear 94, and wobble seat 136 for connecting rod 96. Connecting rod 96 includes ball 138, which is disposed in a socket within piston 72.

Gear 94 rotates land 132 and rod 100, which rotates within sleeve 102 and bushing 134. Wobble seat 136 comprises a cylindrical-like structure having a surface revolved about an axis that is offset from the axis about which land 132 and rod 100 rotate. As land 132 revolves, the axis of wobble seat 136 orbits the axis of rod 100, making a cone-like sweep. Bearing 98 is disposed in a plane transverse to the axis of wobble seat 136. As such, bearing 98 undulates, or wobbles, with respect to a plane transverse to rod 100. Connecting rod 96 is connected to the outer diameter end of bearing 98, but is prevented from rotating about rod 100 by ball 138. Ball 138 is connected to piston 72, which is disposed within a piston seat in bracket 62 such that rotation is prevented. Ball 138 is, however, permitted to move in the axial direction as bearing 138 wobbles. Thus, rotational motion of wobble seat 136 produces linear motion of ball 138 to drive pumping mechanism 18.

Figure 7:
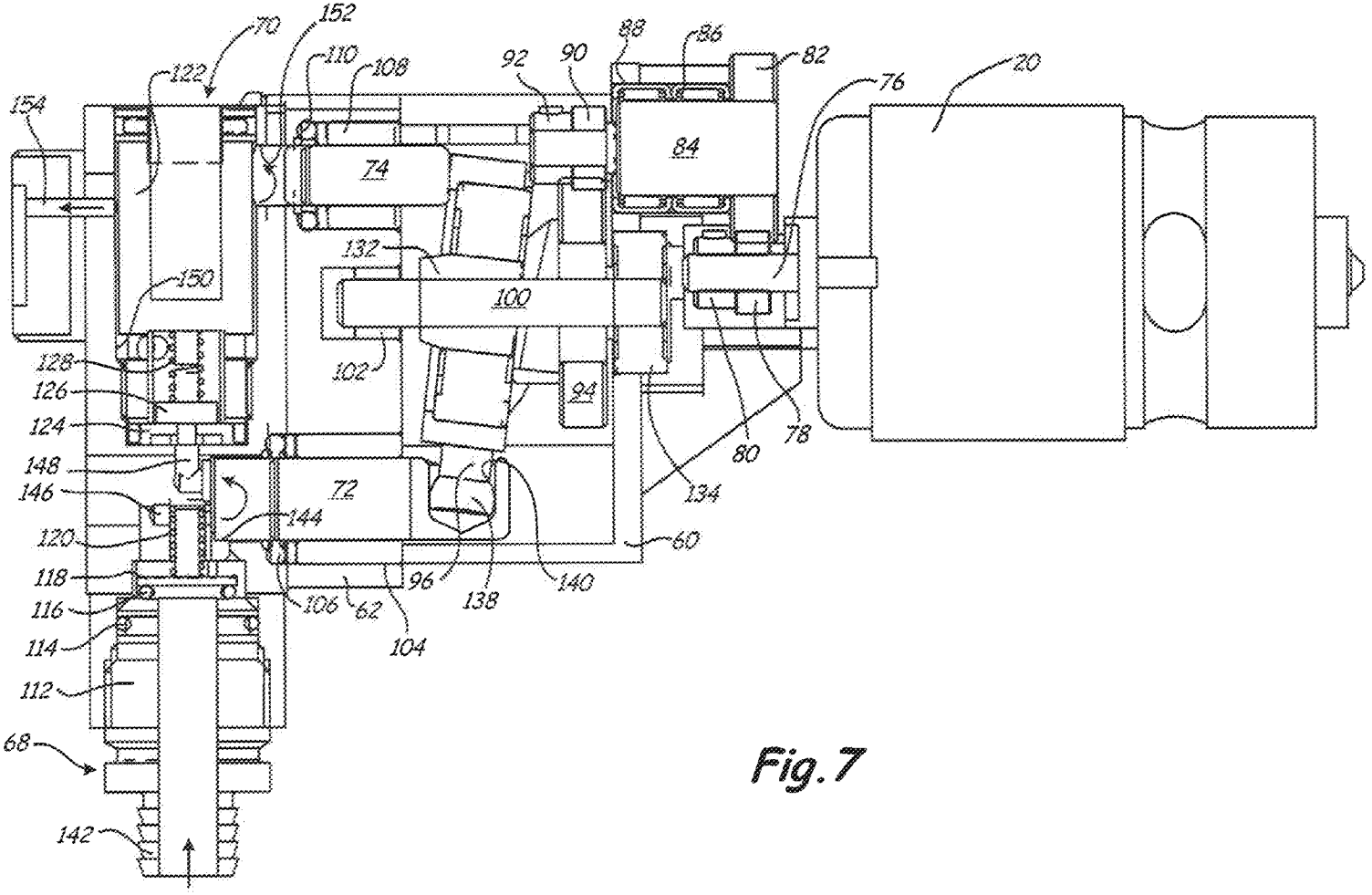
FIG. 7 shows a cross-sectional view of an assembled pumping mechanism and drive element.

FIG. 7 shows a cross-sectional view of pumping mechanism 18 assembled with drive element 20. Drive element 20 comprises a mechanism or motor for producing rotation of drive shaft 76. In the embodiment shown, drive element 20 comprises a DC (direct current) motor that receives electrical input from battery 26, or another electrical power source. In other embodiments, drive element comprises an AC (alternating current) motor that receives electrical input by plugging into a power outlet. In various other embodiments, drive element may comprise a pneumatic motor that receives compressed air as an input, a linear actuator, a gas engine or a brushless DC motor. A compressed air motor or a brushless DC motor provide intrinsically safe drive elements that eliminate or significantly reduce electrical and thermal energy from the drive element. This allows for use of spray gun 10 with combustible or flammable liquids or in environments where combustible, flammable or other hazardous materials are present. First gear 78 is fit over drive shaft 76 and is held in place by bushing 80. Bushing 80 is secured to shaft 76 using a setscrew or another suitable means.

First gear 78 meshes with second gear 82, which is connected to shaft 84. Shaft 84 is supported in bracket 62 by bushings 86 and 88. Gear 90 is disposed on a reduced diameter portion of shaft 84 and secured in place using bushing 92. Bushing 92 is secured to shaft 84 using a setscrew or another suitable means. Gear 90 meshes with gear 94 to rotate rod 100. Rod 100 is supported by sleeve 102 and bushing 134 in brackets 62 and 60, respectively. Gears 78, 82, 90 and 94 provide a gear reduction means that slows the input to rod 100 from the input provided by drive element 20. Depending on the type of pumping mechanism used and the type of drive element used, various sizes of gears and gear reductions can be provided as is needed to produce the desired operation of pumping mechanism 18. For example, pumping mechanism 18 needs to be operated at speeds sufficient for generating desired fluid pressures. Specifically, in order to provide highly desirable, fine finishes with sprayer 10, pressures of about 1,000 psi (pounds per square inch) [~6.9 MPa] to 3,000 psi [~20.7 MPa] are advantageous. In one embodiment of pumping mechanism 18, a gear reduction of approximately 8 to 1 is used with a typical 18V DC motor. In another embodiment of pumping mechanism 18, a gear reduction of approximately 4 to 1 is used with a typical 120V DC motor, using a DC to AC bridge.

As is described with respect to FIGS. 6A and 6B, rotation of rod 100 produces linear motion of ball 138 of connecting rod 96. Ball 138 is mechanically connected to socket 140 of piston 72. Thus, connecting rod 96 directly actuates piston 72 in both advanced and retracted positions. Piston 72 advances and retracts within piston sleeve 104 in bracket 62. As piston 72 retreats from the advanced position, fluid is drawn into valve 68. Valve 68 includes stem 142 to which suction tube 48 connects. Suction tube 48 is submerged within a liquid inside fluid container 16 (FIG. 3). The liquid is drawn into pumping chamber 144 around valve stem 118 and through inlet 146. Valve stem 118 is biased against valve cartridge 112 by spring 120. Seal 116 prevents fluid from passing between cartridge 112 and stem 118 when stem 118 is closed. Seal 114 prevents fluid from passing between cartridge 112 and bracket 62. Valve stem 118 is drawn away from cartridge 112 by suction produced by piston 72. As piston 72 advances, fluid within pumping chamber 144 is pushed through outlet 148 toward valve 70.

Fluid pressurized in chamber 144 is pushed into pressure chamber 150 around valve stem 126 of valve 70. Valve stem 126 is biased against bracket 62 by spring 128. Seat 124 prevents fluid from passing between stem 126 and bracket 62 when stem 126 is closed. Valve stem 126 is forced away from bracket 62 as piston 72 moves toward the advanced position, as spring 120 and the pressure generated by piston 72 closes valve 68. Pressurized fluid from pumping chamber 144 fills pressure chamber 150, comprising the space between cartridge 122 and bracket 62, and pumping chamber 152. The pressurized fluid also forces piston 74 to the retracted position. Cartridge 122 reduces the volume of pressure chamber 150 such that less fluid is stored within pumping mechanism 18 and the velocity of fluid being passed through mechanism 18 is increased, which assists in clean up. The volume of pumping chamber 144 and the displacement of piston 72 is larger than the displacement of piston 74 and the volume of pumping chamber 152. In one embodiment, the displacement of piston 72 is twice as large as the displacement of piston 74. In another embodiment, piston 72 has a 0.4375 inch (~1.1 cm) diameter with a 0.230 inch (~0.58 cm) stroke, and piston 74 has a 0.3125 inch (~0.79 cm) diameter with a 0.150 inch (~0.38 cm) stroke. As such, a single stroke of piston 72 provides enough fluid to fill pumping chamber 152 and maintain pressure chamber filled with pressurized fluid. Additionally, piston 72 has a large enough volume to push pressurized fluid through outlet 154 of bracket 62. Providing suction from only a single, larger piston provides improved suction capabilities over providing suction by two smaller pistons.

As piston 72 retreats to draw additional fluid into pumping chamber 144, piston 74 is pushed forward by connecting rod 96. Piston 72 is disposed within piston sleeve 108 in bracket 62, and piston seal 110 prevents pressurized fluid from escaping pumping chamber 152. Piston 72 advances to evacuate fluid pushed into pumping chamber 152 by piston 72. The fluid is pushed back into pressure chamber 150 and through outlet 154 of bracket 62. Piston 72 and piston 74 operate out of phase with each other. For the specific embodiment shown, piston 74 is one-hundred eighty degrees out of phase with piston 74 such that when piston 74 is at its most advanced position, piston 72 is at its most retracted position. Operating out of phase, pistons 72 and 74 operate in synch to provide a continuous flow of pressurized liquid to pressure chamber 150 while also reducing vibration in sprayer 10. In one embodiment, pumping mechanism operates at approximately 4,000 pulses per minute with each piston operating at approximately 2,000 strokes per minute.

Figure 18:
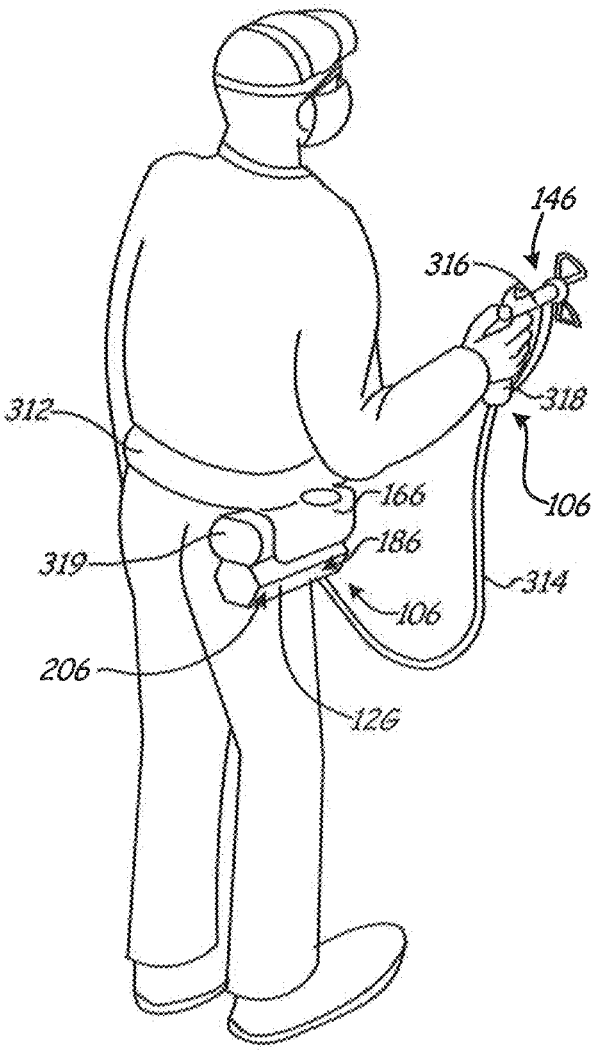
FIG. 18 shows a perspective view of a first variation of a hose-connected airless spray gun embodiment of the dispensing device of FIG. 1 utilizing a waist-mounted sprayer pack.

Pressure chamber 150 acts as an accumulator to provide a constant flow of pressurized fluid to outlet 154 such that a continuous flow of liquid can be provided to valve 52 and spray tip assembly 14 (FIG. 3). In other embodiments, additional mechanical means can be connected to pressure chamber 150 to provide an assisted accumulator device. For example, pressure chamber 150 can be connected to a bladder, diaphragm, hose or bellows to provide external pressure to fluid passing through chamber 150 to outlet 154. In particular, a hose can be used to connect pumping mechanism 18 to spray tip assembly 14 to provide an accumulator function, as shown in FIG. 18, for example.

In another embodiment, pumping mechanism 18 may comprise a double-displacement single piston pump in which a single piston pressures two cylinders one-hundred eighty degrees out of phase. In other embodiments, three or more pumping chambers may be pressurized out of phase to provide an even more smooth spray distribution. For example, a triplex plunger or piston pump may be used. In yet other embodiments, a gerotor (generated rotor), gear pump or rotary vane pump may be used.

Figure 8:
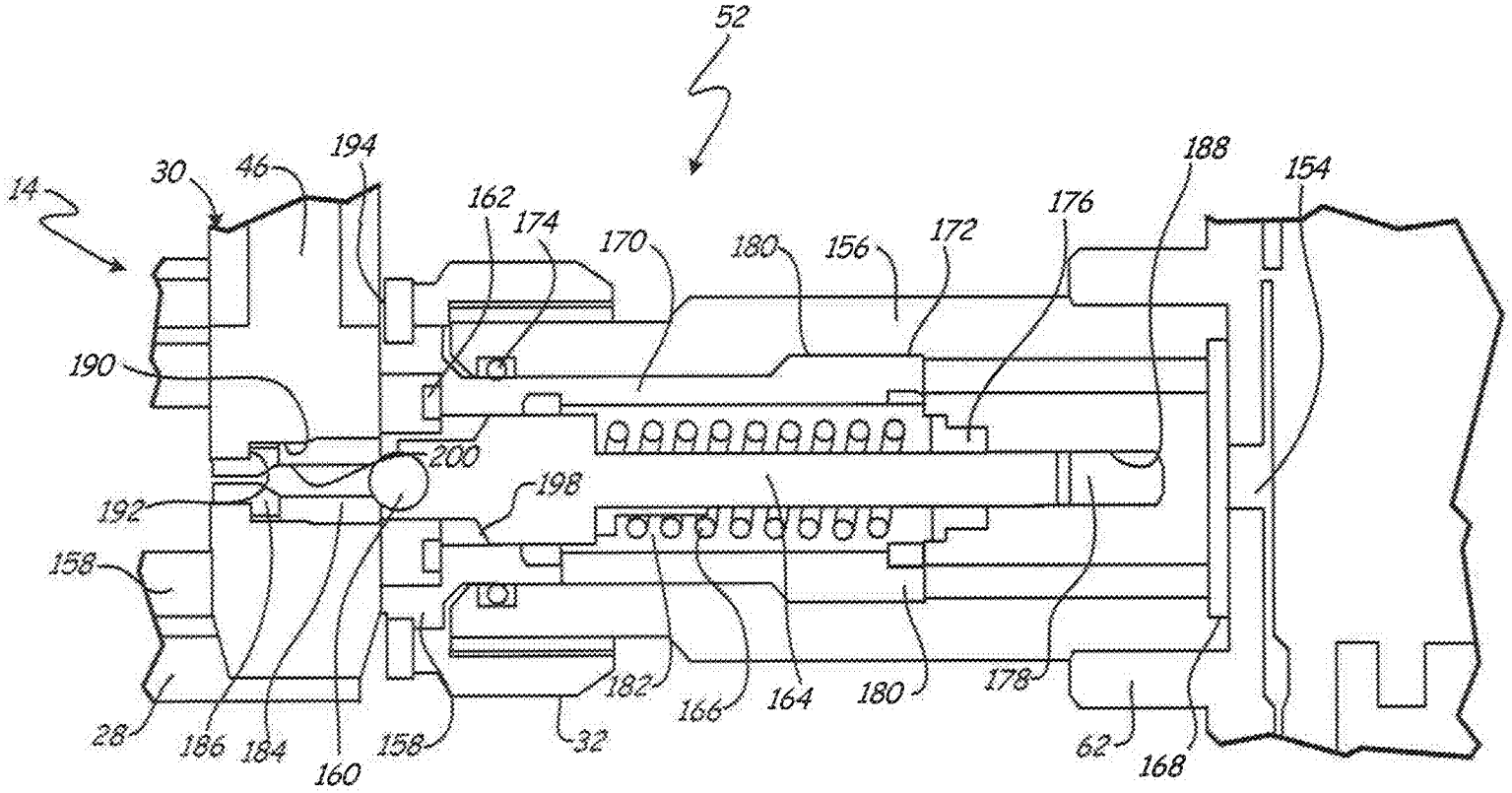
FIG. 8 shows a side cross-sectional view of a valve of the spray tip assembly of FIG. 3.
Figure 9:
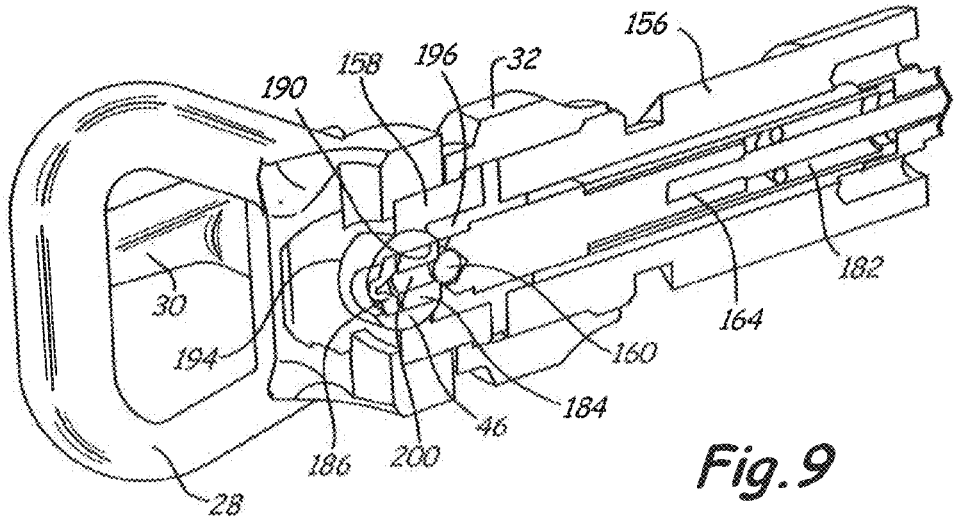
FIG. 9 shows a bottom cross-sectional view of the valve of FIG. 8.

FIG. 8 shows a side cross-sectional view of valve 52 and spray tip assembly 14. FIG. 9, which is discussed concurrently with FIG. 8, shows a bottom cross-sectional view of valve 52 and spray tip assembly 14. Valve 52 includes cylinder 156, cap 158, ball tip 160, seal 162, needle 164, spring 166, seal 168, spring dampers 170 and 172, seal 174, seal 176, stopper 178, fluid passage 180 and filter 182. Spray tip assembly 14 includes guard 28, connector 32, spray tip 30, which includes barrel 46, seat 184 and spray orifice 186.

Cylinder 156 of valve 52 is threaded into a socket within bracket 62 of pumping mechanism 18. Seal 168 prevents fluid from leaking between bracket 62 and cylinder 156. Spring damper 172, spring 166 and spring damper 170 are positioned around needle 164, and filter 182 is positioned around needle 164 and spring 166. Stopper 178 is inserted into axial bore 188 within cylinder 156. Needle 164 and filter 182 are inserted into cylinder 156 and needle 164 extends into axial bore 188 within cylinder 156. Seal 176 prevents fluid from leaking into the axial bore within cylinder 156. Filter 182 connects cap 158 with cylinder 156 to extend fluid passage 180 in an annular flow path toward cap 158. Cap 158 is inserted into fluid passage 180 of cylinder 156. Seal 174 prevents fluid from leaking between cylinder 156 and cap 158. Seal 162 is inserted into cap 158 to surround integrated ball tip 160 of needle 164. Connector 32 is threaded onto cylinder 156 to maintain seal 162 engaged with cap 158 and needle 164 disposed within cylinder 156.

Spray orifice 186 is inserted into bore 190 within barrel 46 of spray tip 30 and abuts shoulder 192. Seat 184 is inserted into bore 190 and maintains orifice 186 against shoulder 192. Spray tip 30 is inserted into transverse bore 194 in cap 158 such that seat 184 aligns with needle 164. Ball tip 160 is biased against seat 184 by spring 166. Seat 184 includes a contoured surface for engaging ball tip 160 such that flow of pressurized fluid is prevented from entering spray tip 30. Guard 28 is positioned around cap 158.

Upon activation of pumping mechanism 18, such as by operation of trigger 24, pressurized fluid is provided to outlet 154. Fluid from pumping mechanism 18 is pushed into valve 52 through outlet 154. The fluid travels through fluid passage 180, around filter 182, to engage cap 158. At cap 158, the pressurized fluid is able to pass between cap 158 and needle 164 at passage 196 (as shown in FIG. 9) so as to be positioned between seal 162 and land 198 of needle 164. The pressure of the fluid against land 198, and other forward facing surfaces of needle 164, forces needle 164 to retract within cylinder 156. Spring 166 compresses between dampers 170 and 172, which inhibit spring 166 from vibrating during pulsation of the pressurized fluid from pumping mechanism 18. Stopper 178 inhibits needle 164 from moving too far and reduces the impact of needle 164 against cylinder 156. In one embodiment, spring 166 fully compresses at approximately 1,000 psi (~6.9 MPa) and is closed at approximately 500 psi (~3.4 MPa). With needle 164 retracted, pressurized fluid is able to pass into seal 162 and into bore 200 of seat 184. From bore 200, the pressurized fluid is atomized by orifice 186. In one embodiment, orifice 186 atomizes un-thinned (e.g. no water is added to reduce viscosity) architectural coatings to about approximately 150 microns using an orifice diameter of approximately 0.029 square inches (0.736 $mm^2$). In another embodiment, orifice 186 atomizes the pressurized architectural coating to about approximately 70 microns on a Dv(50) scale.

In other embodiments of the invention, valve 52 may comprise an assembly in which seat 184 is integrated into cylinder 156, as is shown and discussed later in greater detail with reference to FIG. 13B. For example, a pressure actuated shutoff valve may be used, such as a Cleanshot™ shutoff valve available from Graco Minnesota Inc., Minneapolis, Minn. Such valves are described in U.S. Pat. No. 7,025,087 to Weinberger et al., which is assigned to Graco Minnesota Inc. For example, with valve seat 184 disposed in cylinder 156, needle 164 does not extend all the way up to barrel 46. As such, the space between orifice 186 and ball tip 160 is extended such that bore 200 is effectively lengthened. This leaves a significant volume of liquid within bore 200 after activation of pumping mechanism 18 and closing of valve 52. This liquid remains un-atomized upon a subsequent activation of pumping mechanism 18, potentially causing undesirable spitting or splattering of fluid. Such a spray tip comprises a conventional design and an exemplary embodiment is described in U.S. Pat. No. 3,955,763 to Pyle et al., which is assigned to Graco Minnesota Inc.

However, the embodiment of FIGS. 8 and 9 achieves advantages over such designs. Seat 184 and spray orifice 186 are integrated into barrel 46 such that when spray tip 30 is removed from spray tip assembly 14, seat 184 and orifice 186 are also removed. This reduces the number of parts as compared to previous designs. For example, additional seals and fastening element are not needed. Also, integration of orifice 186 into barrel 46 reduces the volume of un-atomized fluid sprayed from orifice 186. Specifically, the space between orifice 186 and ball tip 160 is shortened by moving seat 184 into barrel 46 and lengthening needle 164 to reach seat 184 in barrel 46. Thus, the volume of bore 200 is reduced.

Figure 10:
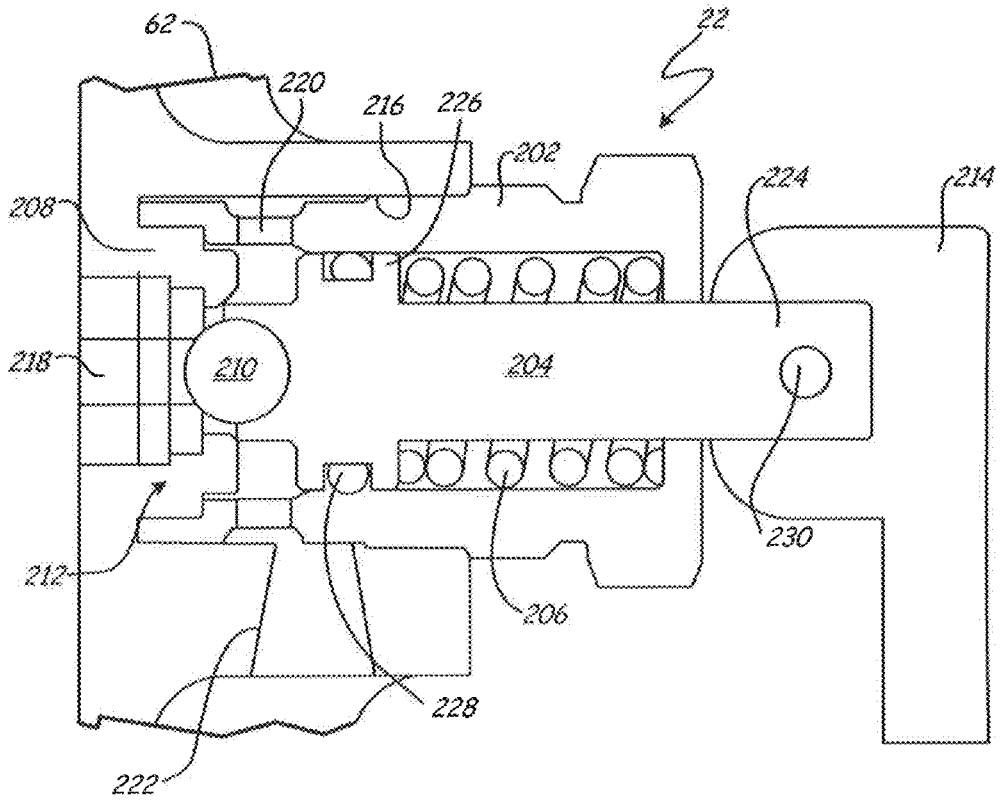
FIG. 10 shows a cross-sectional view of a pressure relief valve used in the pumping mechanism of FIG. 4.

FIG. 10 shows a cross-sectional view of pressure relief valve 22 used in pumping mechanism 18 of FIG. 4. Pressure relief valve 22 includes body 202, plunger 204, spring 206, seat 208, ball 210, seals 212 and lever 214. Body 202 is threaded into bore 216 of bracket 62 to engage bore 218. Bore 218 extends into bracket 62 to engage pressure chamber 150 (FIG. 7). Body 202 also includes transverse bore 220 which extends through body 202 to align with vent 222 in bracket 62. Vent 222 receives return line 50 (FIG. 3), which extends into fluid container 16 (FIG. 3). As such a complete circuit is formed between fluid container 16, suction tube 48, pumping mechanism 18, pressure chamber 150, relief valve 22 and return line 50. Plunger 204 is inserted into body 202 such that stem 224 extends through body 202 and flange 226 engages the interior of body 202. Seal 228 is positioned between body 202 and flange 226 to prevent fluid from within bore 220 from entering body 202. Spring 206 is positioned within body 202 and pushes against flange 226 to bias plunger 204 toward seat 208. Ball 210 is positioned between plunger 204 and seat 208 to block flow between bore 218 and bore 220. Seal 212 prevents fluid from leaking past ball 210.

Valve 22 prevents pumping mechanism 18 from becoming over pressurized. Depending on the spring rate of spring 206, plunger 204 will be displaced when pressure within pressure chamber 150 reaches a desired threshold level. At such level, bore 218 is connected with bore 220 to allow liquid within pressure chamber 150 to travel into vent 222. Thus, the liquid is returned to container 16 and can be recycled by pumping mechanism 18. For example, in one embodiment, valve 52 is configured to open at 1,000 psi (~6.9 MPa), while valve 22 is configured to open at 2,500 psi (~17.2 MPa). In various embodiments of the invention, plunger 204 can be provided with an adjustment mechanism to set the distance that plunger 204 is withdrawn from seat 208 so that valve 22 can be used to automatically or manually adjust flow of pumping mechanism 18.

Valve 22 also provides a priming mechanism for pumping mechanism 18. Upon initiating a new use of sprayer 10, before fluid has filled pumping mechanism 18, it is desirable to purge air from within sprayer 10 to prevent spitting or inconsistent spraying of fluid from tip 14. As such lever 214, which is connected to stem 224 by hinge 230, can be pushed or pulled by an operator to withdraw ball 210 from engagement with seat 208. Thus, upon activation of pumping mechanism 18, air from within sprayer 10 is displaced by fluid from container 16 and purged from sprayer 10 through vent 222. Thus, when lever 214 is released, valve 52 will open upon pressurization from fluid rather than pressurized air and the initial stream of atomized fluid will be consistent.

Valve 22 also provides a means for depressurizing sprayer 10 after use. For example, after operation of sprayer 10 when drive element 20 has ceased operating pumping mechanism 18, pressurized fluid remains within sprayer 10. It is, however, desirable to depressurize sprayer 10 such that sprayer 10 can be disassembled and cleaned. Thus, displacement of lever 214 opens valve 22 to drain pressurized fluid within pumping mechanism to container 16.

Figure 11:
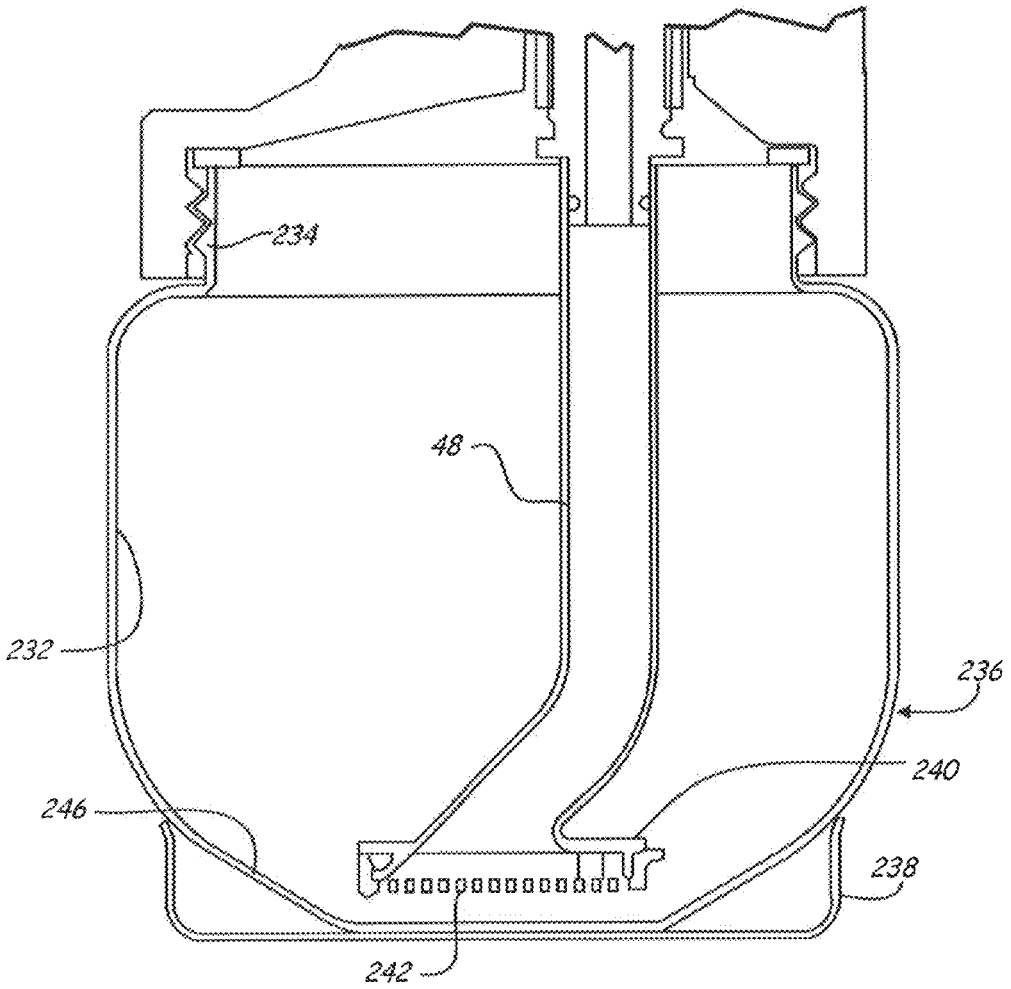
FIG. 11 shows a cross-sectional view of a first embodiment of a fluid cup of FIG. 3.

FIG. 11 shows a cross-sectional view of a first embodiment of a fluid container 16 of FIG. 3. Fluid container 16 comprises a generally cylindrical container 232 having lip 234 and contoured bottom 236. Lip 234 is connected to sprayer 10 through threaded engagement with lid 36 of housing 12 (FIG. 3). Bottom 236 is provided with base 238, which is connected to container 232 to provide a flat bottomed surface upon which container 232 can rest while remaining upright. Suction tube 48 extends from pumping mechanism 18 into the interior of container 16. In the embodiment shown, suction tube 48 comprises a fixed tube that reaches the bottom of container 232 near bottom 234. Suction tube 48 is curved to reach the center of container 232, where bottom 234 is flat. Suction tube 48 includes inlet 240, which faces the flat portion of bottom 236, and filter 242. Inlet 240 extends over approximately the entire surface area of the flat portion of bottom 236. Bottom 236 includes curved portion 246, which funnels fluid within container 232 toward inlet 240. As such, suction tube 48 is able to evacuate most of the volume of liquid provided in container 232 as sprayer 10 is disposed in an upright position.

Figure 12B:
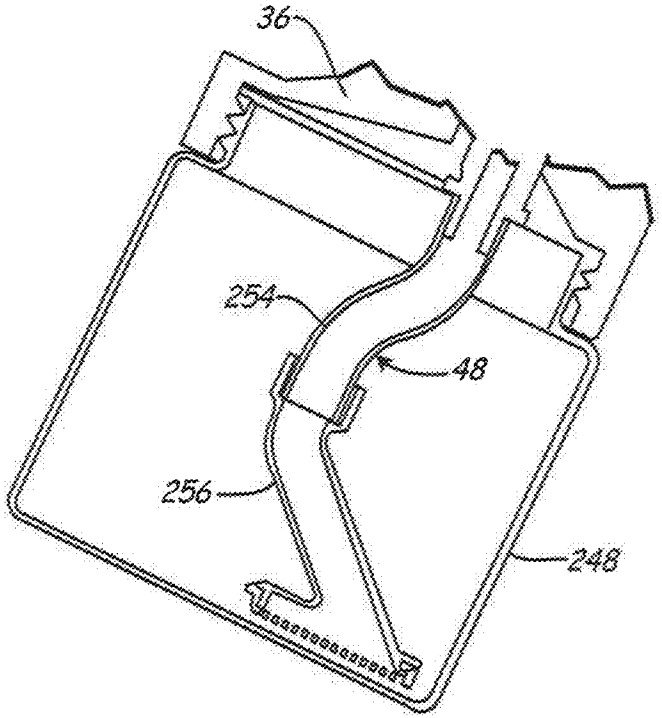
FIGS. 12A & 12B show cross-sectional views of a second embodiment of a fluid cup of FIG. 3.
Figure 12A:
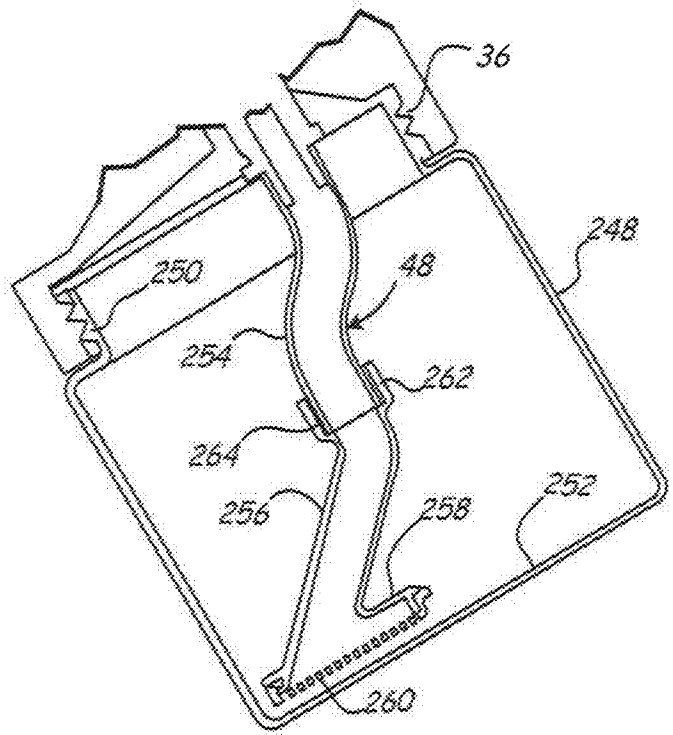

FIGS. 12A & 12B show cross-sectional views of a second embodiment of fluid container 16 of FIG. 3. Fluid container 16 comprises a cylindrical container 248 having lip 250 and flat bottom 252. Suction tube 48 extends into the interior of container 248. In the embodiment shown, suction tube 48 comprises a two-piece tube having upper portion 254 and lower portion 256. Upper portion 254 includes a curved portion to reach the center of container 248. Lower portion 256 extends from upper portion 258 at an angle to reach bottom 252. Lower portion 256 is rotatably attached to upper portion 258 such that inlet 258, which includes filter 260, can be disposed about the entire perimeter of cylindrical wall of container 248. Lower portion 256 includes coupling 262 that fits over the lower end of upper portion 254. Seal 264 is positioned between coupling 262 and upper portion 254 to prevent fluid from escaping tube 48. As such, lower portion 256 can be rotated to a forward position as shown in FIG. 12A to spray, e.g. floors, in a downward orientation. Also, lower portion 256 can be rotated to an aft position as shown in FIG. 12B to spray, e.g. ceilings, in an upward orientation. Lower portion 256 can be rotated in a variety of manners. Lower portion 256 can be moved manually by an operator, such as before liquid is provided to container 248. In another embodiment, a magnetic knob is provided on the bottom of container 248 to move inlet 258.

Figure 13A:
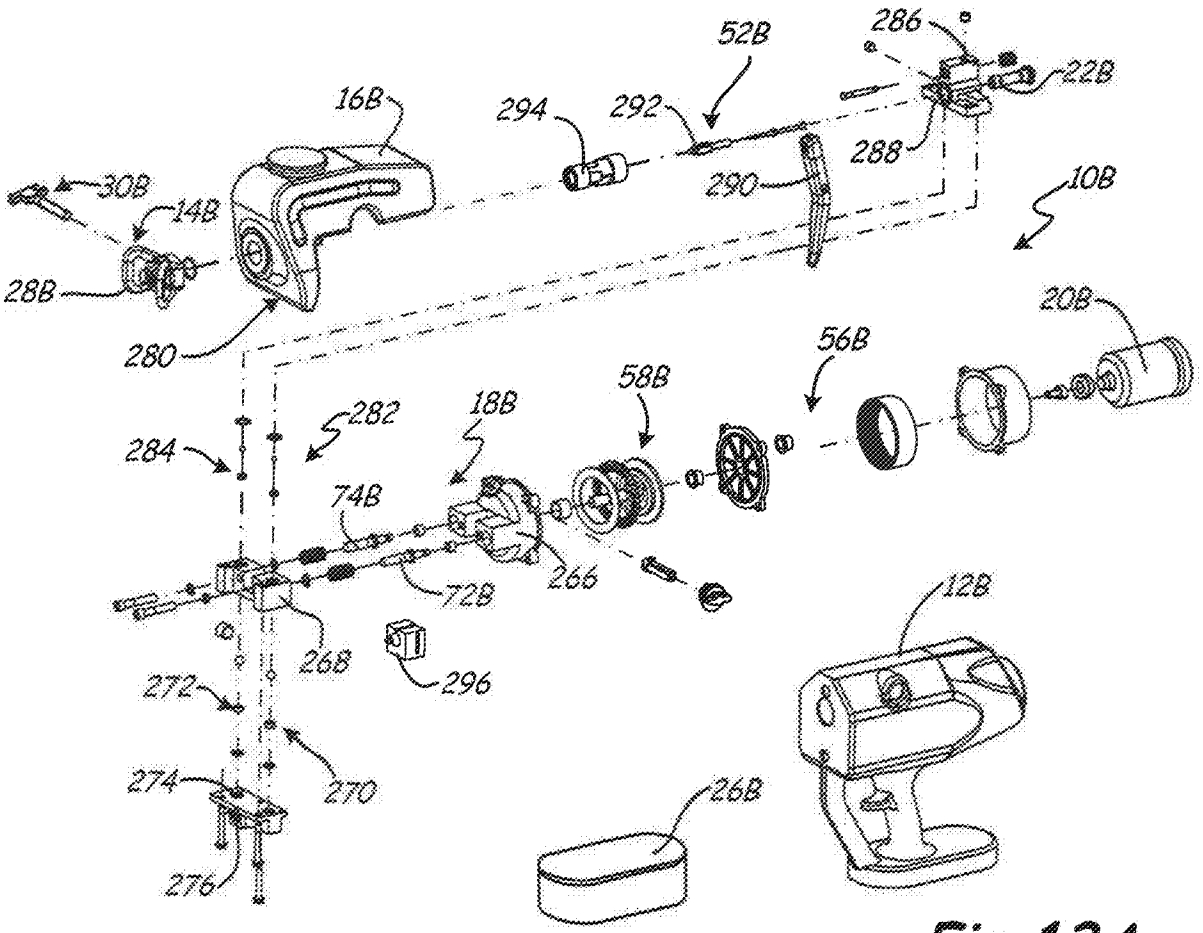
FIG. 13A shows an exploded view of a second variation of a handheld sprayer embodiment of the dispensing device of FIG. 1 utilizing a dual piston pump.

FIG. 13A shows an exploded view of a second variation of a handheld sprayer embodiment of dispensing device 10 of FIG. 1. Spray gun 10B includes similar components as spray gun 10 of FIG. 3, such as housing 12B, spray tip assembly 14B, fluid container 16B, pumping mechanism 18B, drive element 20B, relief valve 22B, battery 26B, guard 28B, spray tip 30B, valve 52B, gearing assembly 56B and connecting assembly 58B. Pumping mechanism 18B comprises a dual piston pumping assembly in which each piston is directly connected to container 16B and provides pressurized fluid to tip 14B. Pumping mechanism 18B includes first piston 72B and second piston 74B, both of which have the same displacement. Pistons 72B and 74B reciprocate within piston cylinders in housings 266 and 268 by direct coupling with connecting assembly 58B. Pistons 72B and 74B are reciprocate out of phase to reduce vibration and pulsation of liquid atomized by spray tip assembly 14B. Pistons 72B and 74B draw fluid from container 16B in through inlet valves 270 and 272, respectively, which are disposed in housing 274. Housing 274 includes inlet 276 which draws fluid from lower portion 280 of container 16B. Pistons 72B and 74B push fluid into outlet valves 282 and 284, respectively, which are disposed in housing 286. Housing 286 includes outlet 288 that connects to valve 52B. Valve 52B comprises a mechanically actuated valve that is connected to lever 290. Lever 290 withdraws pin or needle 292 from a valve seat within cylinder 294 to allow pressurized fluid into spray tip assembly 14B. Lever 290 is also electrically coupled to switch 296 that activates drive element 20B, which in the embodiment shown comprises an electric motor. Drive element 20B provides input power to pumping mechanism 18B through gearing assembly 56B, which provides a gear reduction function, and connecting assembly 58B, which converts rotational input power from drive element 20B to reciprocating linear motion for driving pistons 72B and 74B. For example, gearing assembly 56B may comprise a planetary gear set and connecting assembly 58B may comprise a wobble plate assembly. In another embodiment of the invention, piston 72B and piston 74B can be connected to different fluid containers to provide mixing within spray gun 10B.

Figure 13B:
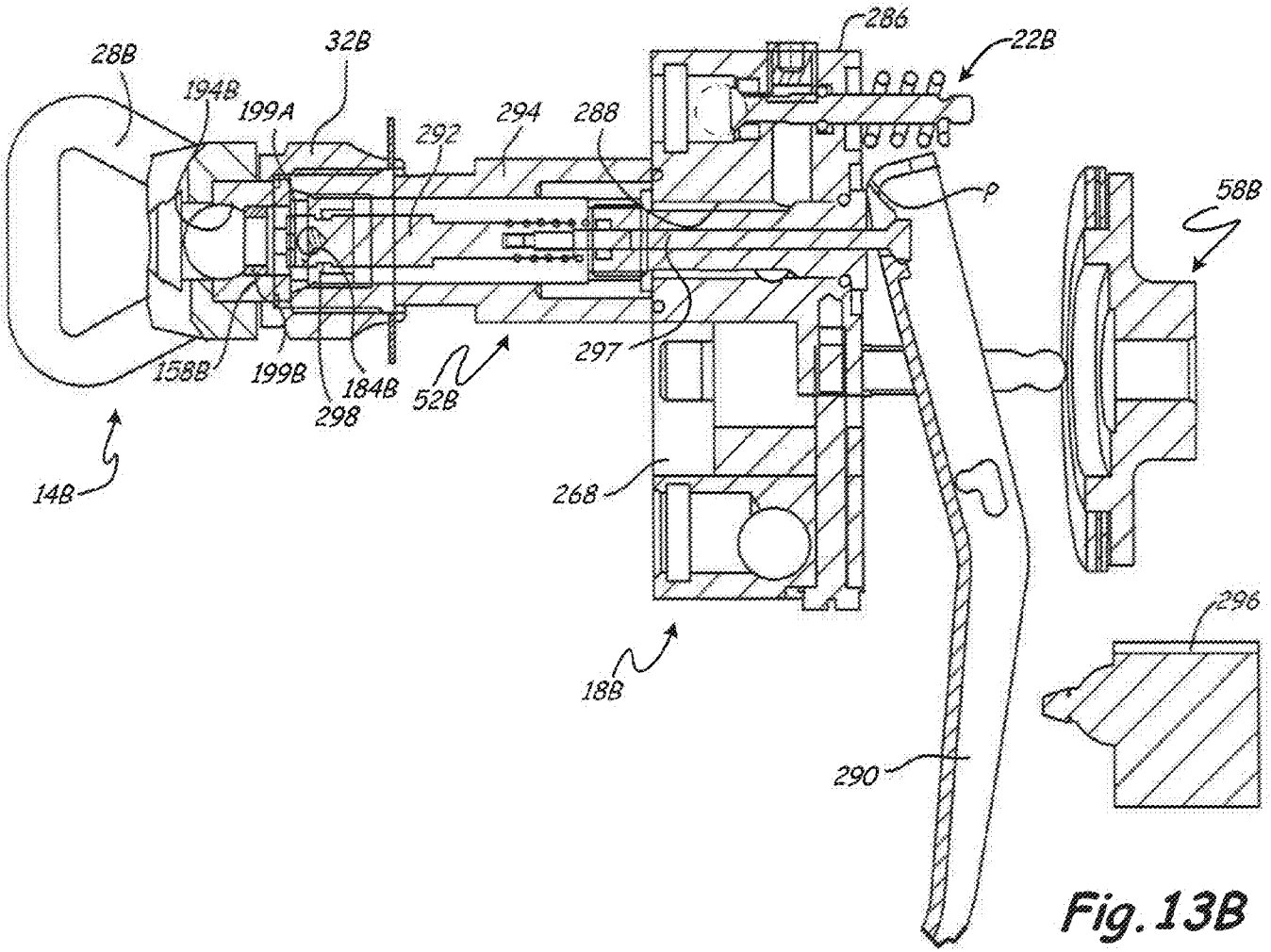
FIG. 13B shows a cross-sectional assembled view of various components of the handheld sprayer of FIG. 13A.

FIG. 13B shows a cross-sectional assembled view of various components of spray gun 10B of FIG. 13A. Spray gun 10B includes spray tip assembly 14B, pumping mechanism 18B, shutoff valve 52B and connecting assembly 58B. As is discussed with reference to FIG. 13A, connecting mechanism 58 receives input from drive element 20B to provide power to pumping mechanism 18B. Pumping mechanism 18B is connected to shutoff valve 52B to control flow of pressurized fluid from pumping mechanism 18B to spray tip assembly 14B. Shutoff valve 52B and drive element 20B are both activated by actuation of lever 290. Specifically, lever 290 is configured to pivotably rotate against housing 12B at rocker point P. Thus, retraction of the lower portion of lever 290, such as by the hand of an operator, retracts rod 297 to pull pin 292 away from valve seat 184B to allow pressurized fluid into spray tip assembly 14B. Also, lever 290 is retracted to contact switch 296, which is connected to drive element 20B to provide input power to pumping mechanism 18B. As such, mechanical actuation of lever 290 simultaneously activates drive element 20B and shutoff valve 52B.

Shutoff valve 52B comprises a mechanically actuated valve in which valve seat 184B is connected to cylinder 294 via connector 32B and cap 158B. Specifically, connector 32B is threaded onto cylinder 294 to sandwich valve seat 184B and bushing 298 between cap 158B and cylinder 294. Spray tip assembly 14B also includes seals 299A and 299B which are positioned between seat 184B and bushing 298, and bushing 298 and cap 158B, respectively. Guard 28B is connected to cap 158B. Guard 28B and cap 158B form bore 194B for receiving a spray tip assembly having a barrel, which includes a spray orifice for atomizing pressurized liquid. Thus, the spray tip assembly of the barrel and orifice can be inserted and removed from bore 194B easily, such as to change orifice size or clean the orifice. These spray tip assemblies are convenient and easy to manufacture. An example of such a spray tip assembly is described in U.S. Pat. No. 6,702,198 to Tam et al., which is assigned to Graco Minnesota Inc. However, pressurized fluid must extend from seat 184B, across seal 199A, seal 199B and bushing 298, and to the orifice within bore 194B before being atomized and discharged from spray tip assembly 14B, which has the potential to produce spitting. The area between seat 184B and the spray orifice can be reduced by incorporating the valve seat into the spray tip assembly barrel, as is described with reference to FIGS. 8 and 9.

Figure 14:
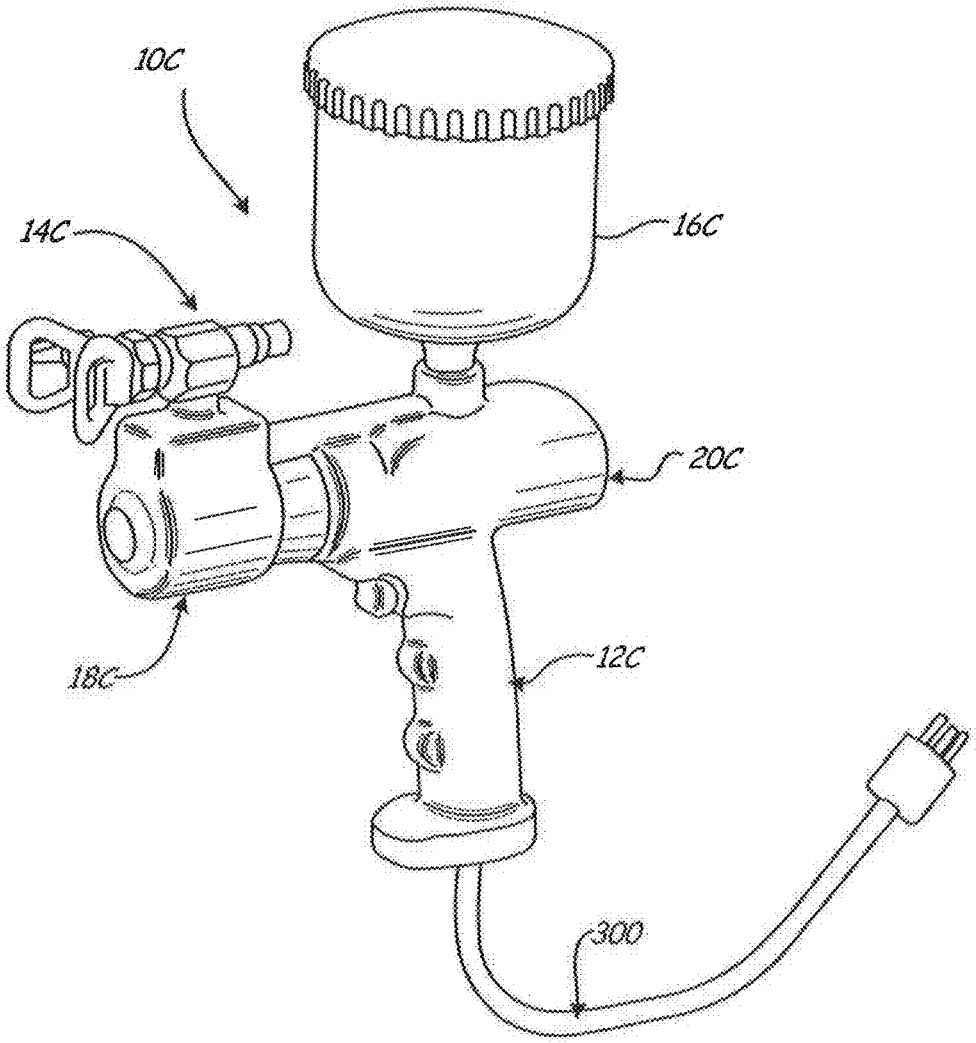
FIG. 14 shows a perspective view of a third variation of a handheld sprayer embodiment of the dispensing device of FIG. 1 utilizing a gravity fed fluid cup.

FIG. 14 shows a perspective view of a third variation of a handheld sprayer embodiment of dispensing device 10 of FIG. 1 utilizing a gravity fed fluid container. Sprayer 10C includes housing 12C, spray tip assembly 14C, fluid cup 16C, pumping mechanism 18C and drive element 20C. Spray tip assembly 14C includes a pressure actuated valve that releases fluid pressurized by pumping mechanism 18C. Pumping mechanism 18C is provided with input power to pressurize a fluid from cup 16C by drive element 20C. Drive element 20C comprises an AC motor having power cable 300, which can be plugged into any conventional power outlet, such as a 110 volt outlet. In other embodiments, drive element 20C can be configured to operate from about 100 volts to about 240 volts. However, any embodiment of the invention can be configured to operate on DC or AC power via a power cord or a battery. Pumping mechanism 18C and drive element 20C are integrated into housing 12C such that sprayer 10C comprises a portable handheld unit. Fluid cup 16C is mounted to the top of housing 12C such that fluid is fed into pumping mechanism 18C via gravitational forces. As such, sprayer 10C does not need suction tube 48 to draw fluid from cup 16C, as fluid is drained directly from cup 16C into an inlet of pumping mechanism 18C within housing 12C.

Figure 15:
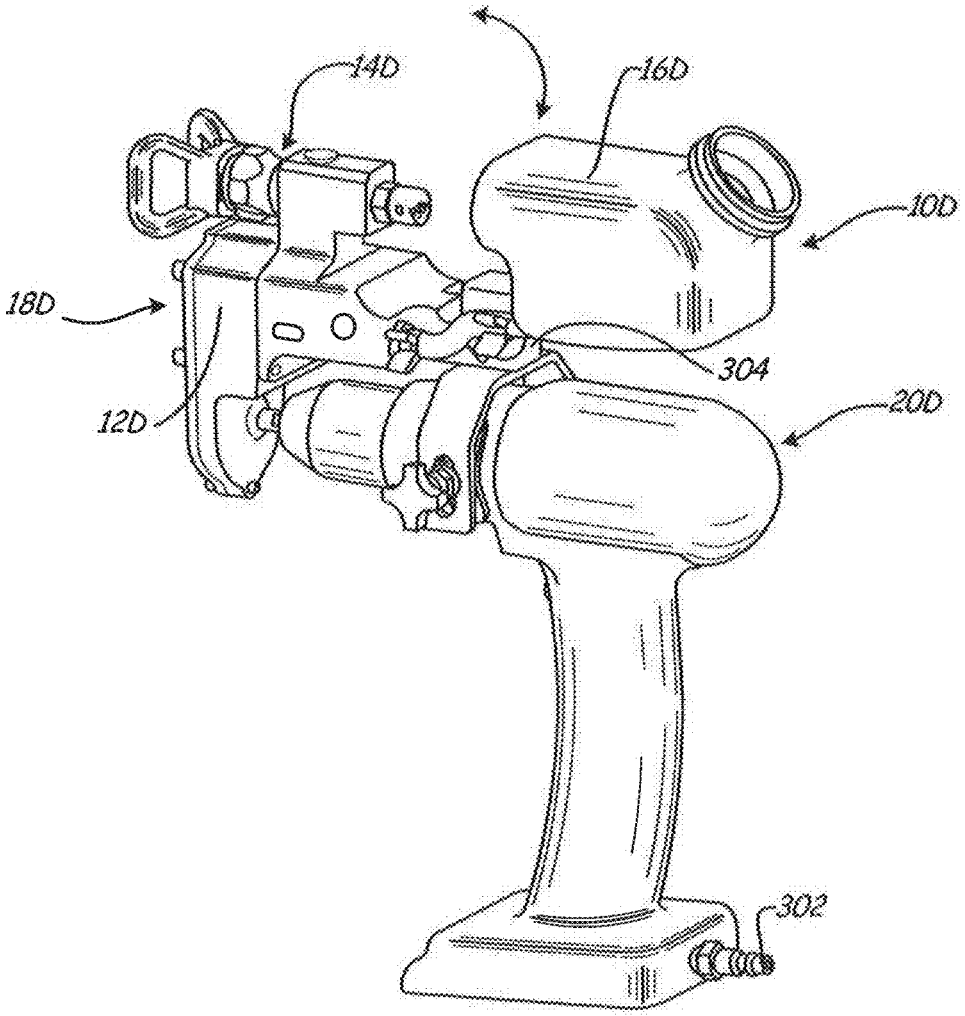
FIG. 15 shows a perspective view of a fourth variation of a handheld sprayer embodiment of the dispensing device of FIG. 1 utilizing a power drill as a drive element.

FIG. 15 shows a perspective view of a fourth variation of a handheld sprayer embodiment of dispensing device 10 of FIG. 1 utilizing a power drill as a drive element. Sprayer 10D includes housing 12D, spray tip assembly 14D, fluid cup 16D, pumping mechanism 18D and drive element 20D. Spray tip assembly 14D comprises a pressure actuated valve that releases fluid pressurized by pumping mechanism 18D. Pumping mechanism 18D is provided with input power to pressurize a fluid from fluid cup 16D by drive element 20D. Drive element 20D comprises a handheld drill. In the embodiment shown, the drill comprises a pneumatic drill that receives compressed air at inlet 302. In other embodiments, however, the drill may comprise an AC or DC electric power drill. Pumping mechanism 18D includes a shaft that can be inserted into a chuck of the power drill to drive the pumping elements. Pumping mechanism 18D is integrated into housing 12D, while drive element 20D and fluid container 16D are mounted to housing 12D. Housing 12D also includes appropriate gear reduction to match speeds of the drill to those needed by pumping mechanism 18D to produce the desired pressures. Pumping mechanism 18D and fluid cup 16D are mounted to the drill using bracket 304. Bracket 304 includes an anti-rotation mechanism that prevents pumping mechanism 18D from rotating with respect to drive element 20D when actuated by the drill. Bracket 304 also pivotably connects fluid cup 16D to the drill. Fluid cup 16D can be rotated on bracket 304 to adjust the angle at which fluid in cup 16D is gravity fed into housing 12D. In one embodiment, fluid cup 16D can be rotated approximately one-hundred-twenty degrees. As such, spray gun 16D can be used to spray in both upward and downward orientations.

FIG. 16 shows a perspective view of a fifth variation of a handheld sprayer embodiment of dispensing device 10 of FIG. 1 utilizing an arm bag fluid reservoir. Sprayer 10E includes housing 12E, spray tip assembly 14E, fluid cup 16E, pumping mechanism 18E and drive element 20E. Sprayer 10E comprises a similar sprayer as that of the embodiment of sprayer 10C of FIG. 14. However, fluid container 16E comprises a flexible bag connected to housing 12E via tube 306. The flexible bag comprises an enclosure similar to that of an IV (intravenous) bag and can be conveniently attached to an operator of sprayer 10E by strap 308. For example, strap 308 can be conveniently attached to an upper arm or bicep of an operator. Thus, an operator need not directly lift the weight of fluid container 16E to operate sprayer 10E, thereby reducing fatigue.

FIG. 17 shows a perspective view of a sixth variation of a handheld sprayer embodiment of dispensing device 10 of FIG. 1 utilizing a hip pack fluid reservoir. Sprayer 10F includes housing 12F, spray tip assembly 14F, fluid cup 16F, pumping mechanism 18F and drive element 20F. Sprayer 10F comprises a similar sprayer as that of the embodiment of sprayer 10C of FIG. 14. However, fluid container 16F comprises a rigid container connected to housing 12F via tube 306. The container comprises an enclosure shaped to be ergonomically attached to an operator of sprayer 10F by belt 310. For example, belt 310 can be conveniently attached to a torso or waist of an operator.

FIG. 18 shows a perspective view of a first variation of a hose-connected airless spray gun embodiment of dispensing device 10 of FIG. 1 utilizing a waist-mounted sprayer pack. Sprayer 10G includes housing 12G, spray tip assembly 14G, fluid cup 16G, pumping mechanism 18G and drive element 20G. Housing 12G of sprayer pack 10G is mounted to a waist of an operator by belt 312. Housing 12G provides a platform upon which fluid container 16G, pumping mechanism 18G and drive element 20G are mounted. Spray tip assembly 14G is connected to pumping mechanism 18G via hose 314. Hose 314 acts as an accumulator to dampen pulsation and vibration in the fluid pressurized by pumping mechanism 18G. Spray tip assembly 14G comprises an airless spray gun having mechanically actuated spray valve 316 that provides pressurized fluid to a spray orifice in ergonomically shaped handheld device 318. Device 318 includes a trigger that opens valve 316. Pumping mechanism 18 G operates to pressurize fluid stored in container 16G and pump the pressurized fluid to device 318 through hose 314. Pumping mechanism 18G is powered by drive element 20G, which comprises a cordless electric motor powered by battery 319. Drive element 20G can be continuously operated by activating a switch located on housing 12G. In such an embodiment, a pressure relief valve or bypass circuit is provided in conjunction with pumping mechanism 18G until valve 316 is actuated by an operator. In another embodiment of the invention, device 318 includes a switch for operating drive element 20G through a cable running along hose 314. The heavier, bulkier components of sprayer 10G are separated from device 318 such that an operator need not continuously lift all the components of sprayer 10G during operation. Fluid container 16G, pumping mechanism 18G and drive element 20G can be conveniently supported by belt 312 to reduce fatigue in operating sprayer 10G.

Figure 19:
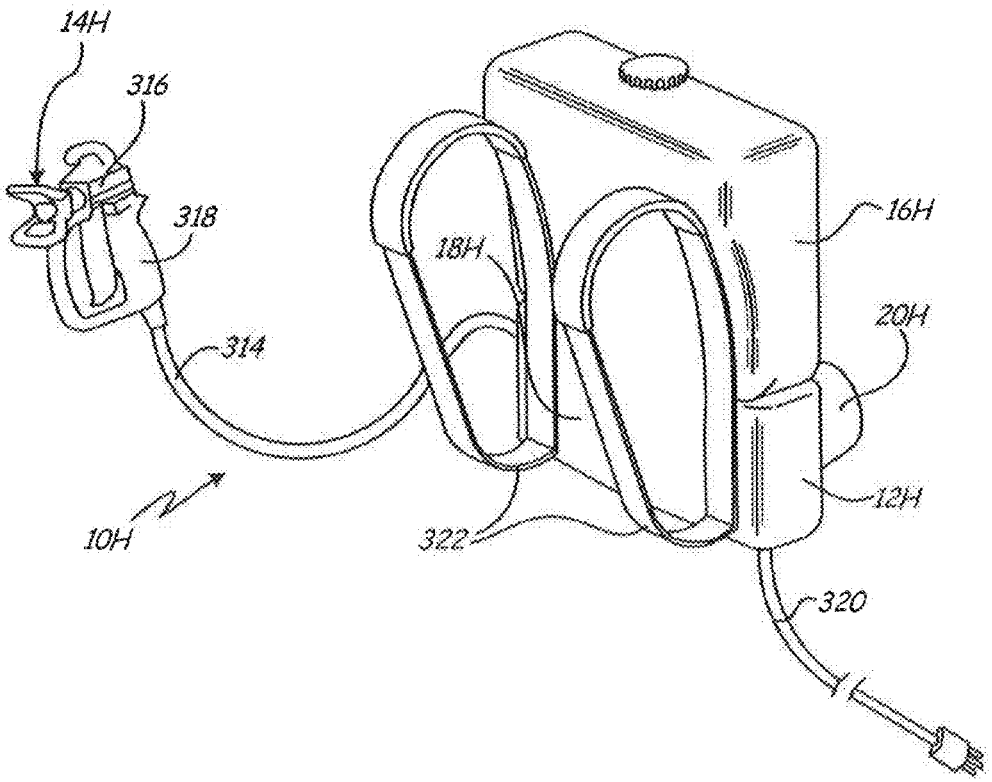
FIG. 19 shows a perspective view of a second variation of a hose-connected airless spray gun embodiment of the dispensing device of FIG. 1 utilizing a back-mounted sprayer pack.

FIG. 19 shows a perspective view of a second variation of a hose-connected airless spray gun embodiment of dispensing device 10 of FIG. 1 utilizing a back-mounted sprayer pack. Sprayer 10H includes housing 12H, spray tip assembly 14H, fluid cup 16H, pumping mechanism 18H and drive element 20H. Sprayer 10H comprises a similar sprayer as that of the embodiment of sprayer 10G of FIG. 18. However, drive element 20H comprises an AC electric motor having power cable 320 configured to be plugged into any conventional power outlet, such as a 110 volt outlet. Also, fluid container 16H, pumping mechanism 18H and drive element 20H are integrated into housing 12H configured to be mounted onto a backpack arrangement. Housing 12H includes straps 322 that permit fluid container 16H, pumping mechanism 18H and drive element 20H to be ergonomically mounted to a back of an operator. Thus, sprayer 10H is similar to that of sprayer 10G, but the backpack configuration increases the capacity of the fluid container. In other embodiments, drive element 20H operates using battery power to increase the mobility of sprayer 10H.

Figure 20:
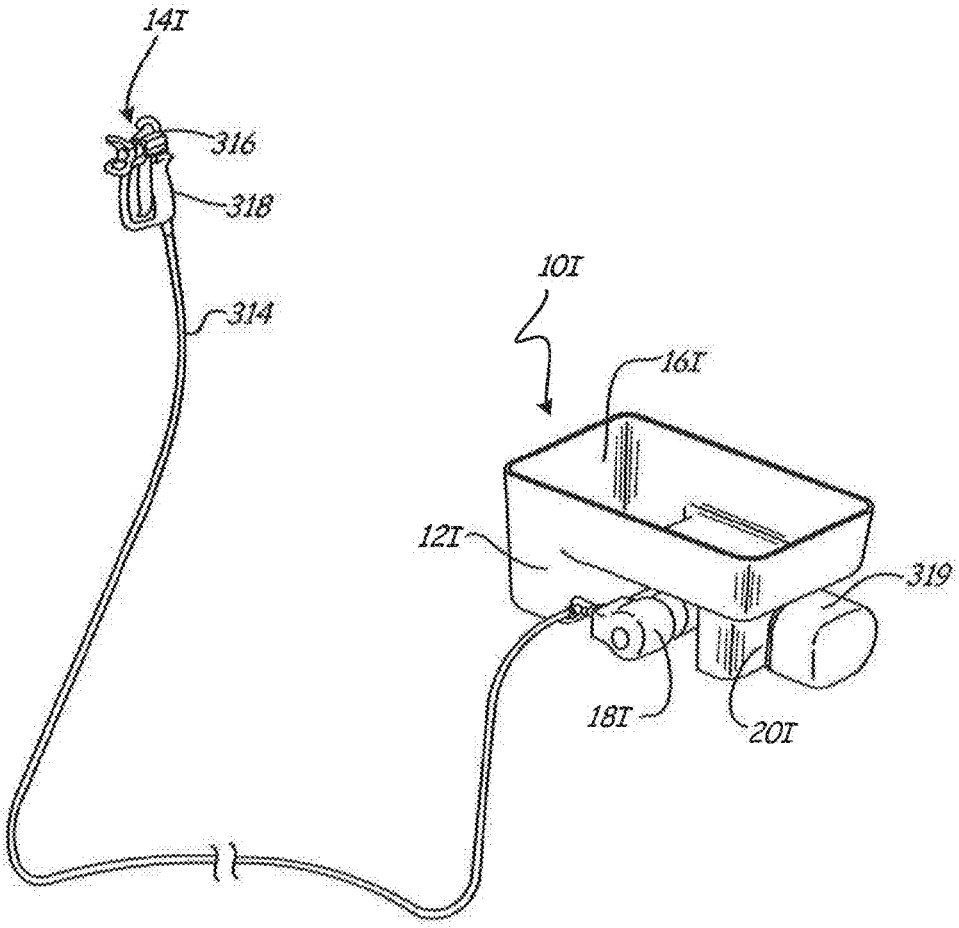
FIG. 20 shows a perspective view of a third variation of a hose-connected airless spray gun embodiment of the dispensing device of FIG. 1 utilizing a hopper-mounted sprayer pack.

FIG. 20 shows a perspective view of a third variation of a hose-connected airless spray gun embodiment of dispensing device 10 of FIG. 1 utilizing a hopper-mounted sprayer pack. Sprayer 10I includes housing 12I, spray tip assembly 14I, fluid cup 16I, pumping mechanism 18I and drive element 20I. Sprayer 10I comprises a similar sprayer as that of the embodiment of sprayer 10G of FIG. 18. However, fluid container 16I of sprayer 10I comprises a hopper. As such, an operator can quickly and easily setup sprayer 10I. Additionally, multiple operators can work off of a single container. The tray surface also provides a direct access point to liquid within container 16I to expand usage of sprayer 10I under different scenarios. For example, a roller can be rested on the tray surface of container 16I while using spray tip assembly 14I to eliminate the need for use of multiple containers. Also, liquid within container 16I can be used even when power to pumping mechanism 18I and drive element 20I is lost. Thus, container 16I reduces wasted fluid and clean up time in a variety of situations and manners. Furthermore, container 16I can be separated from housing 12I to enable easy cleaning of container 16I. Container 16I is designed to remain stationary while an operator moves about with device 318. Thus, an operator need not carry container 16I to reduce fatigue and increase productivity. Fluid container 16I allows a large quantity of liquid to be stored to reduce refill times. Hose 314 is provided with extra length to increase the mobility of the operator.

Figure 21:
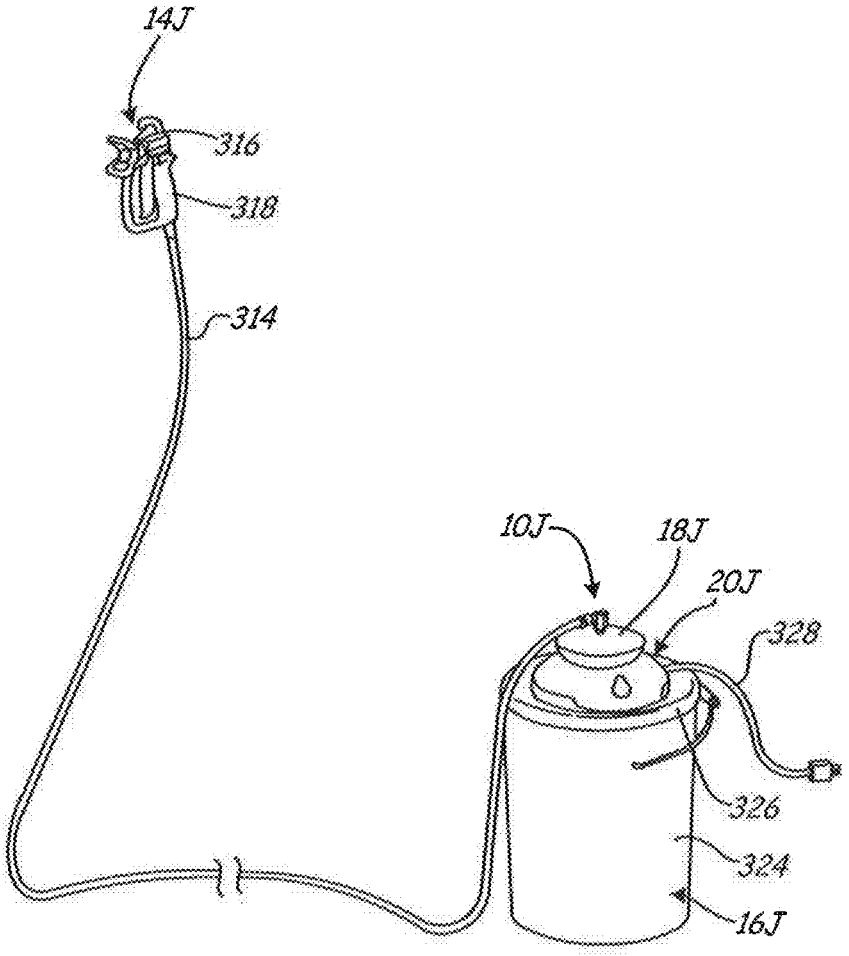
FIG. 21 shows a perspective view of a first variation of a pail-mounted sprayer pack embodiment of the dispensing device of FIG. 1 utilizing a lid-mounted pump.

FIG. 21 shows a perspective view of a first variation of a pail-mounted sprayer pack embodiment of dispensing device 10 of FIG. 1 utilizing a lid-mounted pump. Sprayer 10J includes housing 12J, spray tip assembly 14J, fluid cup 16J, pumping mechanism 18J and drive element 20J. Sprayer 10J comprises a similar sprayer as that of the embodiment of sprayer 10G of FIG. 18. However, fluid container 16J comprises pail 324 having lid 326 upon which pumping mechanism 18J and drive element 20J are mounted. Drive element 20J comprises an AC electric motor having power cable 328 configured to be plugged into any conventional power outlet, such as a 110 volt outlet. Lid 326 is configured to be mounted on a standard five-gallon pail or a standard one-gallon pail to facilitate quick set up of spraying operations and to reduce waste. On operator of sprayer 10J need only open a fresh pail of paint and replace the lid with lid 326 of the present invention to begin operations. Pumping mechanism 18J is completely submerged in pail 324 to eliminate the need for priming. Also, the fluid within container 16J provides cooling to pumping mechanism 18J and drive element 20J.

Figure 22:
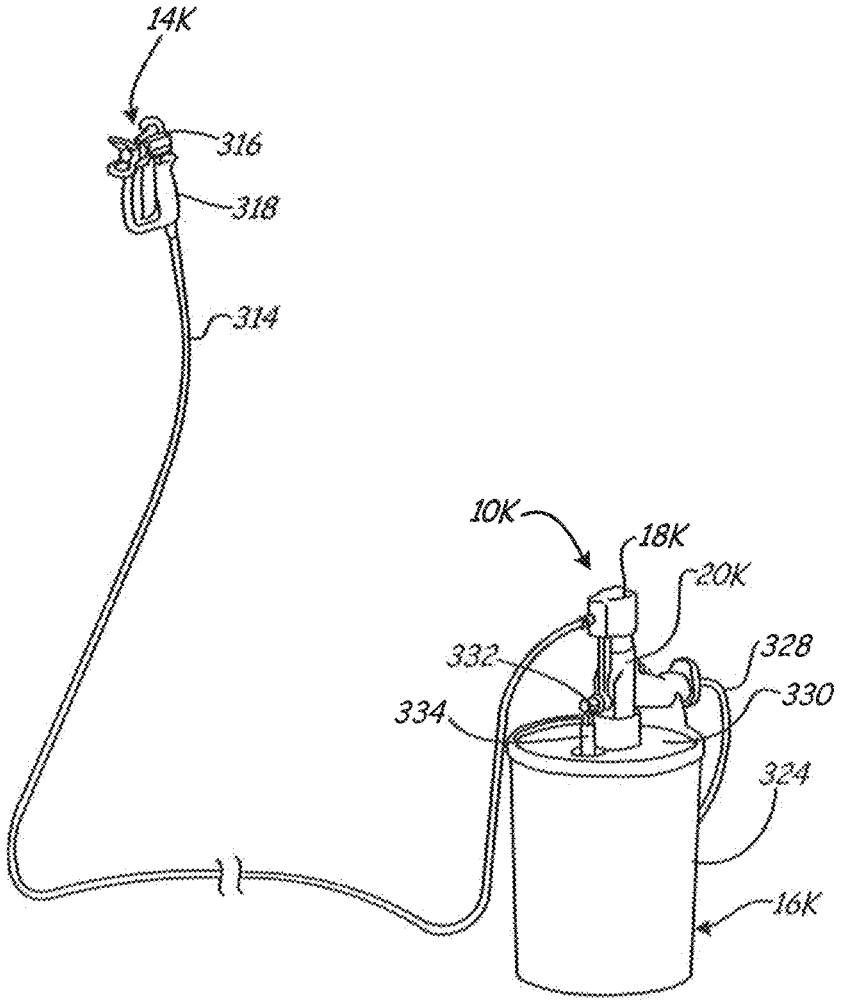
FIG. 22 shows a perspective view of a second variation of a pail-mounted sprayer pack embodiment of the dispensing device of FIG. 1 utilizing a submerged pump.

FIG. 22 shows a perspective view of a second variation of a pail-mounted sprayer pack embodiment of dispensing device 10 of FIG. 1 utilizing a submerged pump. Sprayer 10K includes housing 12K, spray tip assembly 14K, fluid cup 16K, pumping mechanism 18K and drive element 20K. Sprayer 10K comprises a similar sprayer as that of the embodiment of sprayer 10J of FIG. 21. Pumping mechanism 18K comprises a handheld device, similar to that of device 10C of FIG. 14, mounted to lid 330. However, instead of feeding pumping mechanism 18K from a hopper, inlet 332 is connected to the interior of pail 324. As such, inlet 332 connects to a feed tube that extends to the bottom of pail 324. Prime valve 334 is disposed between the feed tube and inlet 332. In other embodiments, pail 324 is pressurized to assist in feeding liquid to inlet 332.

Figure 23:
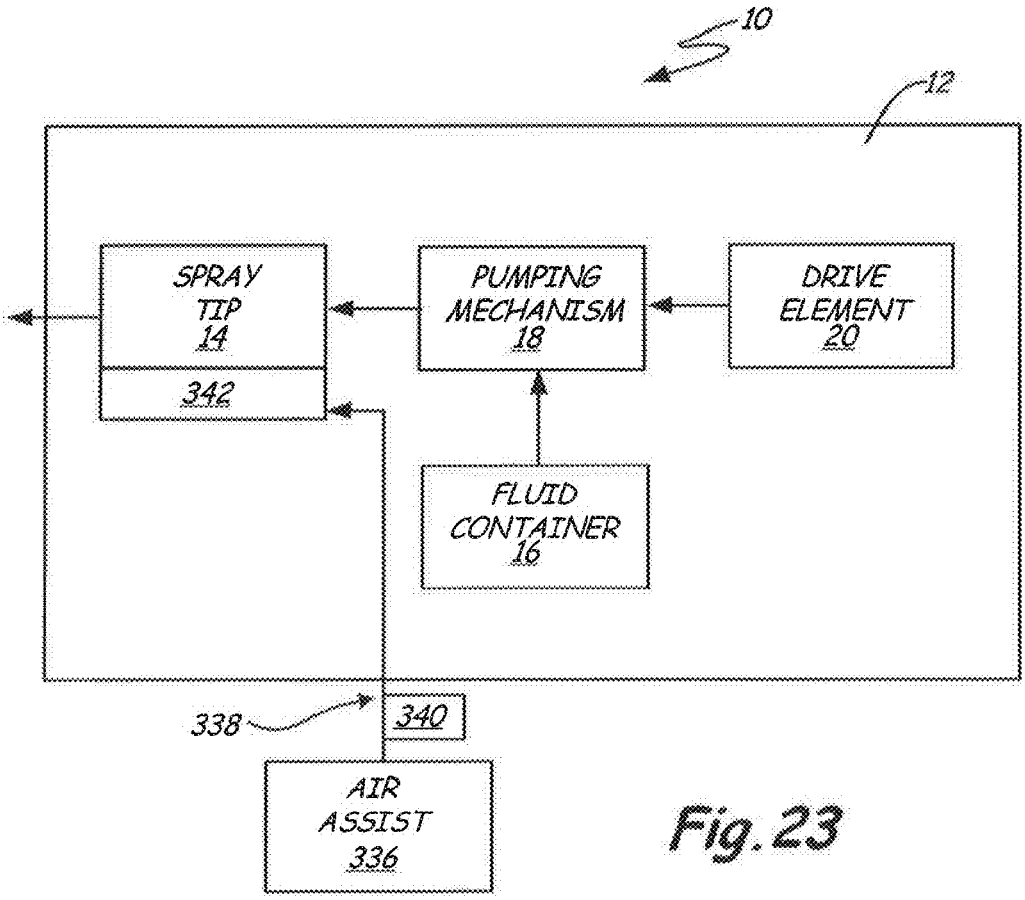
FIG. 23 shows a block diagram of an air-assist assembly for use with the fluid dispensing device of FIG. 1.

FIG. 23 shows a block diagram of dispensing device 10 of FIG. 1 utilizing an air-assist assembly. Device 10 comprises a portable airless spray gun comprising housing 12, spray tip assembly 14, fluid container 16, pumping mechanism 18 and drive element 20, as is described with reference to FIG. 1. Device 10, however, is also provided with air assist assembly 336, which provides compressed air to spray tip assembly 14. Air assist assembly 336 includes air line 338, valve 340 and air nozzle 342. Compressed air from air assist 336 is provided to spray tip assembly 14 through line 338. Line 338 is provided with pressure valve 340 to limit the flow of air into spray tip assembly 14. In one embodiment, air assist assembly 336 includes a compressor. For example, a small, portable, battery operated compressor can be used to provide air to spray tip assembly 14. In another embodiment, air assist assembly 336 includes a tank or cartridge of compressed gas, such as $CO_2$, Nitrogen or air. Spray tip assembly 14 is provides with air nozzle 342, which comprises a passage within tip 14 that enables pressurized air from air assist assembly 336 to join with pressurized fluid from pumping mechanism 18. In one embodiment, spray tip assembly 14 comprises a conventional air-assist spray tip, as are known in the art, that is further provided with an inlet for receiving externally pressurized air rather than internally pressurized air. Such an air-assist spray tip is described in U.S. Pat. No. 6,708,900 to Zhu et al., which is assigned to Graco Minnesota Inc. The compressed air helps push pressurized fluid generated by pumping mechanism 18 through spray tip assembly 14 to further atomize the fluid and provide an improved application of the fluid. Spray tip assembly 14 can be outfitted with a mechanism for adjusting the position of needle 164 in valve 52 to control the atomization of liquid. Also, orifice 186 can be configured, or replaced with another orifice, to optimize air assisted spraying. Thus, air assist assembly 336 increases the versatility of fluid dispensing device 10 to achieve more control over spray parameters and enable use with a wider variety of fluids.

Figure 24:
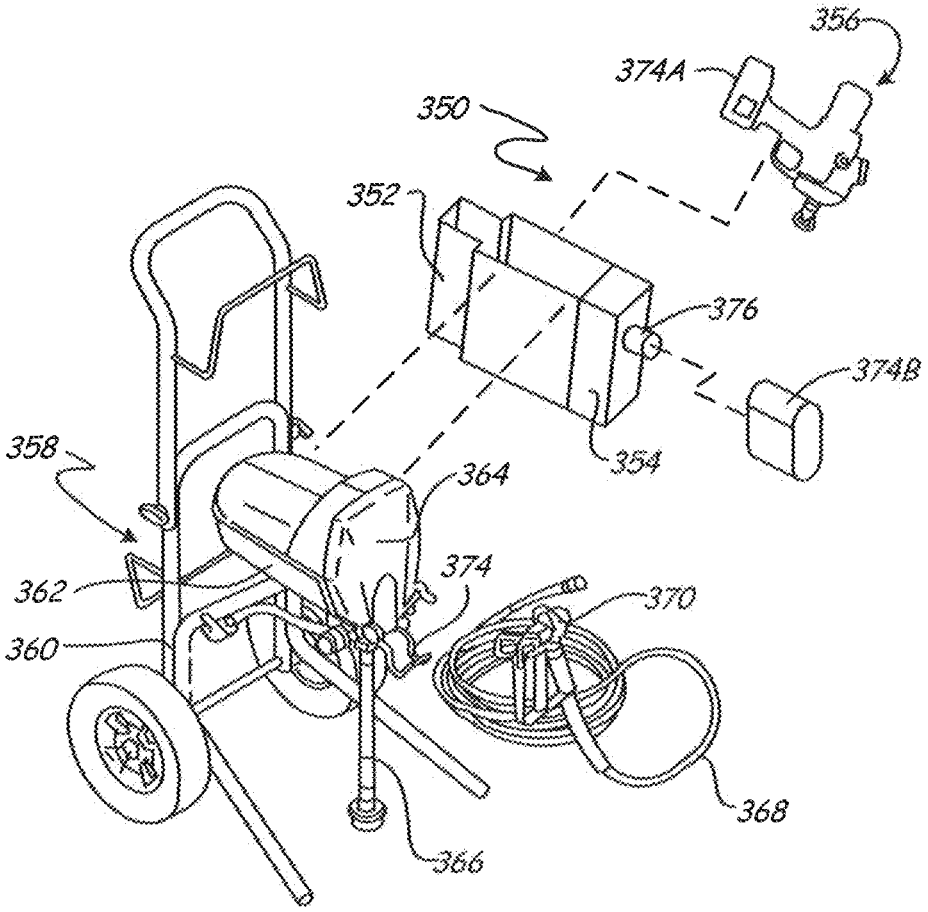
FIG. 24 shows a perspective view of a cart-mounted airless sprayer system having a storage receptacle and battery charger for a portable handheld sprayer.

FIG. 24 shows a perspective view of cart-mounted airless sprayer system 350 having storage receptacle 352 and battery charger 354 for portable handheld sprayer 356. Cart-mounted airless sprayer system 350 is mounted to airless spray system 358, which includes dolly cart 360, motor 362, pump 364, suction tube 366, hose 368 and spray nozzle 370. Airless spray system 358 comprises a conventional airless spray system that is configured for large-scale industrial or professional use. System 358 includes heavy duty motor 362 and pump 364 that are designed for applying large volumes of liquid or paint during each use. Such a motor and pump are described in U.S. Pat. No. 6,752,067 to Davidson et al., which is assigned to Graco Minnesota Inc. For example, suction tube 366 is configured to be inserted into a five-gallon pail of paint that can be suspended from dolly cart 360 with hook 372. Motor 362 is configured to be connected to a conventional power outlet using a power cord to provide input power to pump 364. Spray nozzle 370 is connected to pump 364 using hose 368, which provides ample length for an operator to roam. As such, system 358 comprises a portable spray system that can be wheeled around using cart 360 and then setup to remain stationary while an operator uses spray nozzle 370. Thus, system 358 is well-suited for large jobs, but is inconvenient to move and re-setup, particularly for small jobs.

System 358 is provided with cart-mounted handheld spray system 350 to provide an operator with a convenient and quick system for complementing use of system 358. Handheld spray system 350 is mounted to dolly cart 360 using receptacle 352. Receptacle 352 comprises a container that is bolted or otherwise connected to cart 360. Receptacle 352 comprises a holster for receiving sprayer 356. In one embodiment, receptacle 352 comprises a molded plastic container shaped to firmly hold sprayer 356 and includes a hinged cover. Receptacle 352 is large enough to encase sprayer 356 as well as rechargeable battery 374A. Receptacle 352 also provides a platform on which to mount battery charger 354. Battery charger 354 can be disposed inside of receptacle 352 or connected to the exterior of receptacle 325. Battery charger 354 comprises an electric charger for re-energizing rechargeable batteries 374A and 374B. Battery charger 354 includes adapter 376 to which battery 374B is connected to be charged while battery 374A is in use with sprayer 356. Battery charger 354 is provided with electric power through connection with the power cord that supplies power to motor 362. Thus, battery charger 354 provides recharging capabilities so that batteries 374A and 374B are readily available for use in conjunction with spray system 358.

Spray system 358 and sprayer 356 provide airless spray systems that provide high quality finishes. Spray system 358 is used for bulk application of a liquid or paint. Sprayer 356 is ready to be easily used by an operator in places or spaces where system 358 cannot reach due to, for example, limitations of the power cord or spray hose 368. Sprayer 356 comprises any one of the embodiments of a portable airless sprayer described herein. As such sprayer 356 provides an airless spray finish that is commensurate in quality with the airless spray finish generated by spray system 358. Thus, an operator can switch between using system 358 and sprayer 356 on a single job without noticeable differences in the spray quality.

The present invention, in its various embodiments, is able to achieve high quality sprayed finishes of architectural materials. For example, using a Dv(50) technique, where at least fifty percent of the sprayed droplets meet the atomization target, the present invention achieves atomization listed in the following table.

| Architectural Material | Orifice Size ($in^2$) | Orifice Running Pressure (psi) | Atomization Size [Dv(50)] |
|---|---|---|---|
| Paint | 0.011-0.029 | 360 or greater | 70 microns or less |
| Stain | 0.005-0.015 | 360 or greater | 60 microns or less |

Thus, fluid dispensing devices of the present invention achieve orifice running pressures of approximately 360 psi (~2.48 MPa) or greater in a handheld portable configuration, meeting Underwriters Laboratories® specification UL1450.

Figure 25:
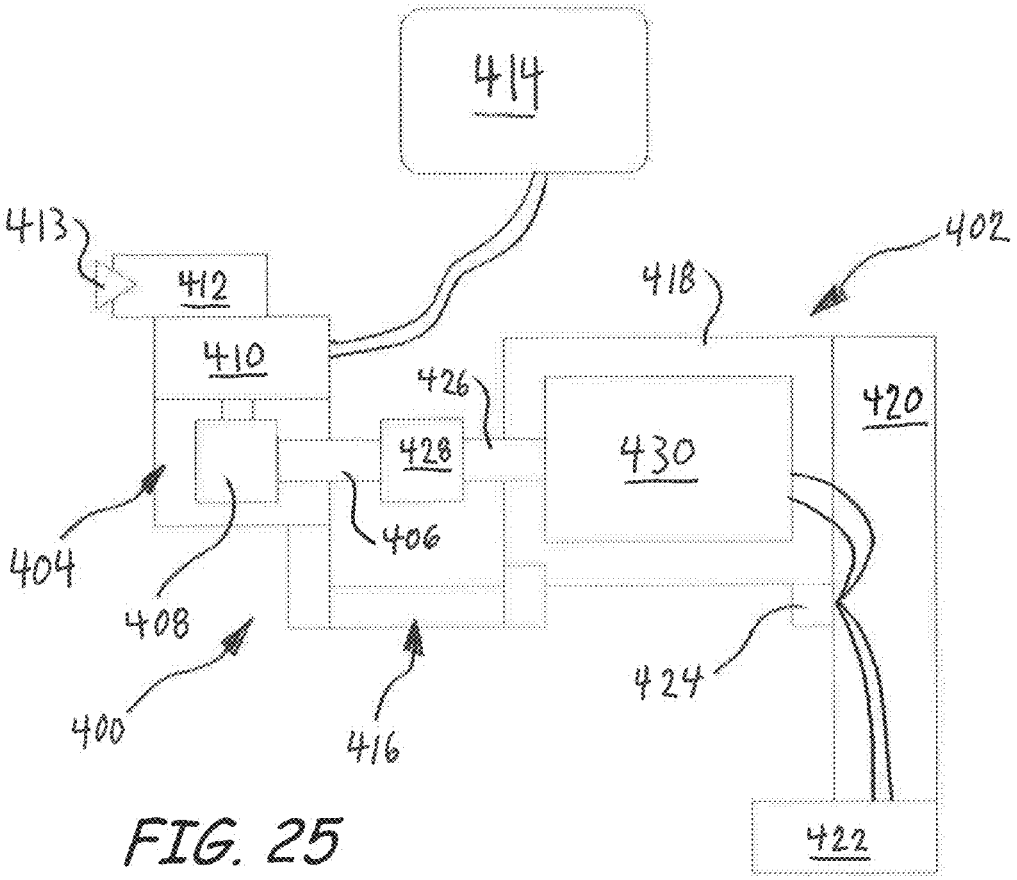
FIG. 25 is a schematic of a sprayer attachment driven through coupling to a handheld, portable power tool.

FIG. 25 is a schematic of sprayer attachment 400 driven through coupling to handheld, portable power tool 402. Sprayer attachment 400 includes attachment housing 404, input shaft 406, converting mechanism 408, pumping mechanism 410, sprayer assembly 412, spray tip 413, container 414 and bracket 416. Power tool 402 includes housing 418 (which includes ergonomic grip 420), battery 422, trigger 424, output shaft 426, coupling 428 and drive element 430.

In one embodiment, power tool 402 comprises an off-the shelf unit that can be purchased by an operator at commercial retail outlets. Drive element 430 comprises an electric motor that is powered by battery 422 upon actuation of trigger 424. Battery 422 may comprise a Lithium battery, a Nickel battery, a Lithium-ion battery or any other suitable rechargeable or non-rechargeable DC battery. Battery 422 is removable from housing 418 so that it can be recharged. Although described with respect to a cordless unit, power tool 402 may, instead of being powered by battery 422, be configured to operate with alternating current (AC) via coupling to a power outlet. Drive element 430 may also comprise an air motor in other embodiments.

Ergonomic grip 420 provides a comfortable location for an operator of power tool 402 to apply leverage to housing 418 in order to operate the unit. Trigger 424 is ergonomically located and includes a switch that allows an operator to selectively provide power from battery 422 to drive element 430. Drive element 430 is configured to provide motion to output shaft 426.

In one embodiment, drive element 430 imparts rotational motion to output shaft 426. Thus, output shaft 426 may be directly driven by an electric motor in drive element 430. In one embodiment, coupling 428 comprises a chuck with jaws, as are known in the art, that can be tightened with our without a key. Power tool 402, thus, comprises a typical cordless power drill in one embodiment.

In another embodiment, drive element 430 imparts reciprocating motion to output shaft 426. In such an embodiment, output shaft 426 may be coupled to a rotatable motor shaft in drive element 430 via a motion conversion device that converts rotational input to reciprocating output. In one embodiment, coupling 428 comprises a clamp, such as a rotatable lever or a threaded fastener. Power tool 402, thus comprises a typical cordless reciprocating saw in one embodiment.

Sprayer attachment 400 is coupled to power tool 402 via bracket 416 and through engagement of coupling 428 with input shaft 406. Input shaft 406 is rotated or reciprocated by output shaft 426 to drive converting mechanism 408. Converting mechanism 408 may comprise a gear reduction system or other gear system, such as for use with rotation of input shaft 406, or a linear-to-rotary system, such as a slider-crank mechanism as is known in the art, for use with reciprocation of input shaft 406. Converting mechanism 408 provides mechanical input to pumping mechanism 410.

Pumping mechanism 410 comprises any one of a number of pumping devices, as have been described in the present disclosure. For example, pumping mechanism 410 may comprise a gear pump, a piston pump, a plunger pump, a vane pump, a rolling diaphragm pump, a ball pump, a rotary lobe pump, a diaphragm pump or a servo motor having a rack and pinion drive. In one embodiment, pumping mechanism 410 comprises a reciprocating piston pump, as is described with reference to FIG. 7. For example, rod 100 (FIG. 7) of pumping mechanism 18 (FIG. 4) may couple to converting mechanism 408, and converting mechanism 408 may comprise gearing assembly 56 (FIG. 4) such that drive shaft 76 (FIG. 7) comprises input shaft 406. However, single-action and double-action single piston pumps may be used, as well as dual piston pumps having pistons of the same displacement.

Pumping mechanism 410 is fluidly coupled to container 414. Container 414 may be mounted to attachment housing 404, similarly as to fluid cup 16D of FIG. 15, or may be configured as a stand-alone container, such as fluid container 16E of FIG. 16, or fluid cup 16F of FIG. 17, or any of fluid cups 16H-16K of FIGS. 19-22, respectively. Pumping mechanism 410 receives unpressurized fluid from container 414, pressurizes the fluid and pumps it to sprayer assembly 412.

Sprayer assembly 412 is fluidly coupled to pumping mechanism 410. Sprayer assembly 412 comprises a mechanism that atomizes pressurized fluid from pumping mechanism 410 into a spray suitable for applying paint and other materials. Sprayer assembly 412 and spray tip 413 may be configured as an airless spray valve and tip that includes an orifice. In one embodiment, sprayer assembly 412 is similar to valve 52 (FIG. 3) such that spray tip 413 comprises barrel 46 (FIG. 3). Thus, sprayer assembly 412 and spray tip 413 may be configured similarly to what is described with reference to FIGS. 8 and 9.

Sprayer assembly 412, pumping mechanism 410 and converting mechanism 408 are contained in or coupled to attachment housing 404 in a single, convenient assembly such that all components can be easily coupled to and removed from housing 418. As mentioned, coupling 428 connects output shaft 426 and input shaft 406. Bracket 416 also connects housing 418 and attachment housing 404. Bracket 416 not only joins sprayer attachment 400 and power tool 402 as a single unit, but provides stability to sprayer attachment 400 when under power from power tool 402. Bracket 416 provides anti-displacement resistance to sprayer attachment 400. For example, bracket 416 may provide anti-rotation stability to prevent sprayer attachment 400 from rotating about the axis of output shaft 426 when output shaft 426 is rotating. Bracket 416 may also provide anti-rocking stability to prevent sprayer attachment 400 from pivoting at housing 418 when output shaft 426 is reciprocating along the axis of output shaft 426.

Figure 26:
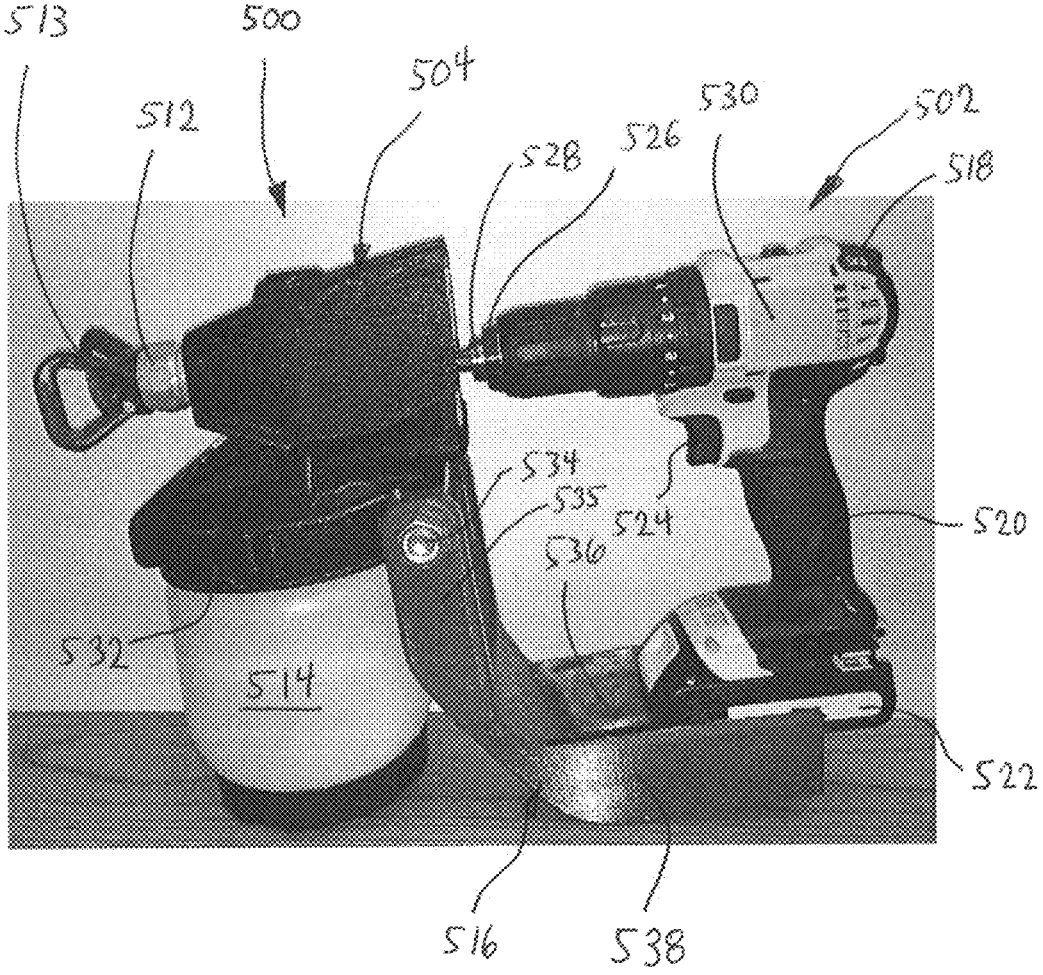
FIG. 26 is a perspective view of a sprayer attachment coupled to a handheld, portable power tool.

FIG. 26 is a perspective view of sprayer attachment 500 coupled to handheld, portable power tool 502. Sprayer attachment 500 includes attachment housing 504, sprayer assembly 512, spray tip 513, container 514 and bracket 516. Power tool 502 includes housing 518 (which includes ergonomic grip 520), battery 522, trigger 524, output shaft 526, coupling 528 and drive element 530. In the embodiment shown, power tool 502 comprises a cordless drill.

Sprayer attachment 500 also includes an input shaft, converting mechanism and pumping mechanism as described with reference to FIG. 25, but such components are disposed within attachment housing 504. Thus, attachment housing 504 comprises a unitary housing in which all of the moving parts of sprayer attachment 500 are contained. For example, the input shaft is recessed into housing 504 such that coupling 528, which comprises a chuck, extends into housing 504. In the embodiment of FIG. 26, container 514 comprises a cup that is mounted underneath housing 504 and sprayer assembly 512 via lid 532. Lid 532 may be integrated into housing 504. Container 514 may comprise a cup, including suction tubes 48, similar to fluid containers 16 described with reference to FIGS. 11-12B. As such, suction tubes 48 (FIGS. 11-12B) fluidly connect the interior of container 514 with the pumping mechanism.

Bracket 516 is coupled to housing 504 at pivot 534. Pivot 534 may comprise a bolted connection that allows bracket 516 to rotate with respect to housing 504 in order to facilitate assembly of power tool 502 with sprayer attachment 500. In the described embodiment, bracket 516 comprises an anti-rotation bracket having arm 535, tray 536 and sidewalls 538. Arm 535 extends from pivot point 534 to space tray longitudinally from housing 504. Tray 536 extends horizontally from arm 535 to support power tool 502. Thus, once properly positioned, pivot 534 can be tightened to support power tool 502 at the appropriate distance from the input shaft within housing 504 to relieve stress at the joint with coupling 528. Tray 536 includes sidewalls 538 to prevent power tool 502 from being displaced from tray 536 when drive element 530 is activated. Specifically, sidewalls 538 resist moment generated by housing 504 and bracket 516 when output shaft 526 is rotated.

Figure 27:
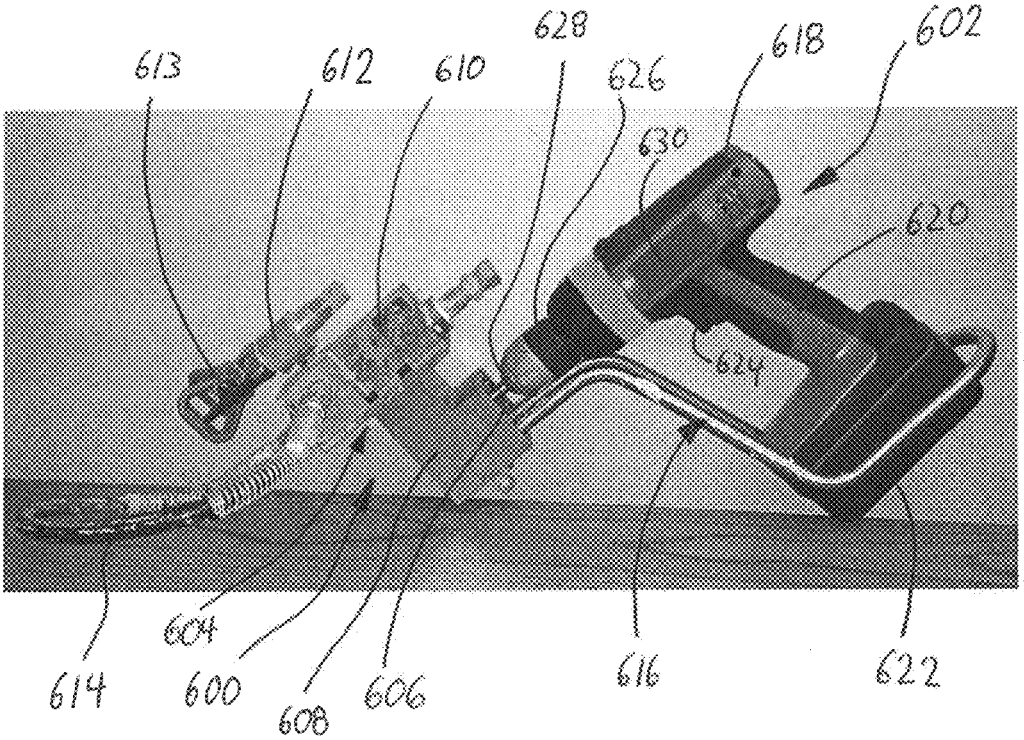
FIG. 27 is a perspective view of a sprayer attachment coupled to a handheld, portable power tool.

FIG. 27 is a perspective view of sprayer attachment 600 coupled to handheld, portable power tool 602. Sprayer attachment 600 includes attachment housing 604, input shaft 606, converting mechanism 608, pumping mechanism 610, sprayer assembly 612, spray tip 613, hose 614 and bracket 616. Power tool 602 includes housing 618 (which includes ergonomic grip 620), battery 622, trigger 624, output shaft 626, coupling 628 and drive element 630. In the embodiment shown, power tool 602 comprises a cordless drill.

Converting mechanism 608, pumping mechanism 610 and sprayer assembly 612 are enclosed in a separate housings that are assembled together to form a single unit as attachment housing 604. Only the housing for converting mechanism 608 is directly coupled to power tool 602. Thus, sprayer attachment 600 can be easily separated from power tool 602. Input shaft 606 extends from the housing for converting mechanism 608 such that coupling 628, which comprises a chuck, can easily join with input shaft 606. In the embodiment of FIG. 27, pumping mechanism 610 is provided with unpressurized fluid through hose 614, which can couple to any container as is described in the present disclosure. For example, hose 614 may be connect to a stand-alone container, such as fluid container 16E of FIG. 16, or fluid cup 16F of FIG. 17, or any of fluid cups 16H-16K of FIGS. 19-22, respectively.

Bracket 616 is coupled to housing 604 at converting mechanism 608. Bracket 616 comprises an anti-rotation bar that extends from converting mechanism 608 below input shaft 606. The anti-rotation bar comprises a single length of bar stock that is wrapped in a U-shape to partially encircle part of power tool 602. Specifically, the anti-rotation bar extends horizontally from converting mechanism 608 at first, then extends at an oblique angle to the axis along which input shaft 606 rotates, and finally again extends horizontally around battery 622. As such, bracket 616 resists moment generated by housing 604 and bracket 616 when output shaft 626 is rotated. Bracket 616 also tightly fits around battery 622 such that anti-rocking resistance is provided. In other embodiments, bracket 616 may be provided with straps or the like to assist in securing (e.g. stiffening) power tool 602 relative to sprayer attachment 600.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A sprayer attachment for a hand-supported power tool, the sprayer attachment comprising:
- a motion converting mechanism having an input shaft;
- a pumping mechanism driven by the motion converting mechanism;
- a spray assembly fluidly coupled to the pumping mechanism;
- a housing assembly that couples the motion converting mechanism, the pumping mechanism and the spray assembly; and
- an anti-rotation bracket comprising:
  - an arm extending outward from the housing assembly;
  - a tray formed by an end of the arm opposite the housing and configured to support the hand-supported power tool with respect to the housing assembly; and
  - sidewalls extending from opposing sides of the tray and engaging the hand-supported power tool such that the sidewalls inhibit rotation of the housing assembly with respect to the hand-supported power tool when the input shaft is rotated by the hand-supported power tool.

2. The sprayer attachment of claim 1 wherein the motion converting mechanism comprises a gear reduction system.

3. A portable airless sprayer comprising:
- a handheld power tool comprising:
  - a drive element;
  - an output coupling actuated by the drive element; and
  - an ergonomic housing on which the drive element and the output coupling are carried;
- a sprayer attachment comprising:
  - an attachment housing, wherein the attachment housing is releasably coupled to the ergonomic housing;
  - a pumping mechanism disposed in the attachment housing;
  - an input shaft connected to the output coupling to drive the pumping mechanism, wherein the output coupling is releasably coupled to the input shaft; and
  - an airless spray tip assembly coupled to the pumping mechanism; and
- a bracket connecting the ergonomic housing and the attachment housing to prevent displacement of the attachment housing while the drive element powers the pumping mechanism, the bracket comprising:
  - an arm extending outward from the sprayer attachment;
  - a tray rigidly joined to an end of the arm opposite the sprayer attachment and configured to support the ergonomic housing with respect to the sprayer attachment; and
  - sidewalls extending from opposing sides of the tray and engaging a distal portion of the ergonomic housing relative to the drive element such that the sidewalls inhibit rotation of the sprayer attachment with respect to the handheld power tool when the output coupling is actuated by the drive element.

4. The portable airless sprayer of claim 3 wherein the output coupling comprises a rotating shaft.

5. The portable airless sprayer of claim 3 wherein the output coupling includes a chuck.

6. The portable airless sprayer of claim 3 wherein the handheld power tool comprises a portable drill.

7. The portable airless sprayer of claim 3 and further comprising:
- a gear reduction system disposed in the attachment housing.

8. The portable airless sprayer of claim 3 wherein the drive element comprises an electric motor.

9. The portable airless sprayer of claim 8 wherein the electric motor is powered by a rechargeable DC battery.

10. A portable sprayer comprising:
- a power tool comprising:
  - a housing having a handle;
  - a drive element disposed in the housing; and
  - an output shaft extending from the drive element and out of the housing;
- a sprayer attachment comprising:
  - a pumping mechanism releasably coupled to the output shaft;
  - a fluid cup configured to provide un-pressurized fluid to the pumping mechanism; and
  - a spray assembly configured to receive pressurized fluid from the pumping mechanism; and
- an anti-rotation bracket coupling the power tool to the sprayer attachment and extending from the sprayer attachment to a distal portion of the handle relative to the output shaft, the anti-rotation bracket comprising:
  - an arm extending outward from the sprayer attachment;
  - a tray rigidly joined to an end of the arm opposite the sprayer attachment and configured to support the handle with respect to the sprayer attachment; and
  - sidewalls extending from opposing sides of the tray and engaging the distal portion of the handle such that the sidewalls inhibit rotation of the sprayer attachment with respect to the power tool when the output shaft is rotated by the power tool.

11. The sprayer attachment of claim 1, wherein the arm is attached to the housing assembly at a pivot permitting rotational adjustment of the tray with respect to the hand-supported power tool.

12. The sprayer attachment of claim 11, wherein the pivot has a tightening mechanism to rotationally restrain the anti-rotation bracket at the pivot.

13. The sprayer attachment of claim 1, wherein the arm extends from the housing assembly such that the tray is spaced longitudinally from the housing assembly.

14. The portable sprayer of claim 10, wherein the anti-rotation bracket is pivotally attached to the sprayer attachment.

* * * * *